United States Patent [19]

Freeman

[11] 4,078,376

[45] Mar. 14, 1978

[54] ELECTRONIC WATCH HAVING OPTICAL AND AUDIBLE READOUTS AND ALARM AND STOPWATCH CAPABILITIES

[76] Inventor: Alfred B. Freeman, 2044 W. 12th St., Emporia, Kans. 66801

[21] Appl. No.: 597,865

[22] Filed: Jul. 21, 1975

[51] Int. Cl.[2] ..... G04C 21/20; G04F 10/02; G04B 19/34

[52] U.S. Cl. ..... 58/38 R; 58/23 R; 58/39.5; 58/50 R; 58/57.5; 58/74; 235/92 T; 324/186

[58] Field of Search ..... 58/23 R, 23 A, 38, 39.5, 58/50 R, 57.5, 74, 85.5; 324/186; 235/92 T

[56] References Cited

U.S. PATENT DOCUMENTS

| | | | |
|---|---|---|---|
| 2,575,759 | 11/1951 | Higinbotham et al. | 324/186 |
| 3,803,834 | 4/1974 | Reese | 58/50 R |
| 3,810,356 | 5/1974 | Fujita | 58/85.5 |
| 3,813,533 | 5/1974 | Cone et al. | 58/152 R |
| 3,852,952 | 12/1974 | Vittoz | 58/85.5 |
| 3,866,406 | 2/1975 | Roberts | 58/55 |
| 3,871,168 | 3/1975 | Maire et al. | 58/85.5 |
| 3,943,696 | 3/1976 | Portmann et al. | 58/23 R |
| 3,953,964 | 5/1976 | Suppa et al. | 58/85.5 |

*Primary Examiner*—E. S. Jackmon

[57] ABSTRACT

An electronic watch providing optical and audible readouts, controlled by a number of predetermined pulse trains, each pulse of which being produced by the user's tapping or otherwise impacting a small electro-acoustic transducer, which also provides the audible readout. A switch may be substituted for the transducer, thus foregoing audible readout capability. An easily learned coded series of tone bursts identifies the numbers in the audible time readout. The alarm capability, armed and disarmed by appropriate pulse trains, includes an alarm register which can be read out and set by appropriate pulse trains and, supplemented by an additional counter to form a duration register, serves as a stopwatch adapted not only for conventional timing of external events, but also for precision setting of the minute and second counters. An auxiliary register may hold month and date information to be read out and set in response to appropriate pulse trains. Security means virtually eliminate the possibility that a random series of pulses might affect the setting of any of the counters or arm the alarm, and provide a series of optical displays separated by dark intervals, each of substantially shorter duration than a display, and constituting a narrow time gate within which a control pulse is effective, a pulse during display aborts operation and reverts the instrument to its quiescent or passive operational state. With low power consumption display elements, e.g. liquid crystal displays, time may be displayed constantly except when the user, by a pulse train, otherwise controls the watch. With higher power consumption elements, time is displayed only when interrogated by the user.

19 Claims, 19 Drawing Figures

| SCANNER POSITION | SELECTOR POSITION | | | | |
|---|---|---|---|---|---|
| | OPTICAL | | | | AUDIO |
| | 1 | 2 | 3 | 4 | 5 |
| 2 | TIME | ALARM | AUX. | MIN./SEC. | HOURS |
| 3 | DEKAMINUTE DISPLAY & OPTIONAL SET | | STOP WATCH | RETARD | DEKAMINUTES |
| 4 | HOUR DISPLAY & OPTIONAL SET | | AUX. SET | ADVANCE | MINUTES |

OSC.
FREQUENCY DIVIDER
TRANSDUCER
SELECTOR
SCANNER
F. F.
P. S.

1 SEC. CNTR.
DEKASEC. CNTR.
FEEDER G. S.
FDER. G. S.
MAST. G. S.
1 MIN. CNTR.
DEKA MIN. CNTR.
HOUR CNTR.
COMP.
AUX. CNTR.
MASTER G. S.
OPTICAL ENCODER
1 SEC. CNTR.
DEKA M./S. CNTR.
HR./M. CNTR.
12 4 5

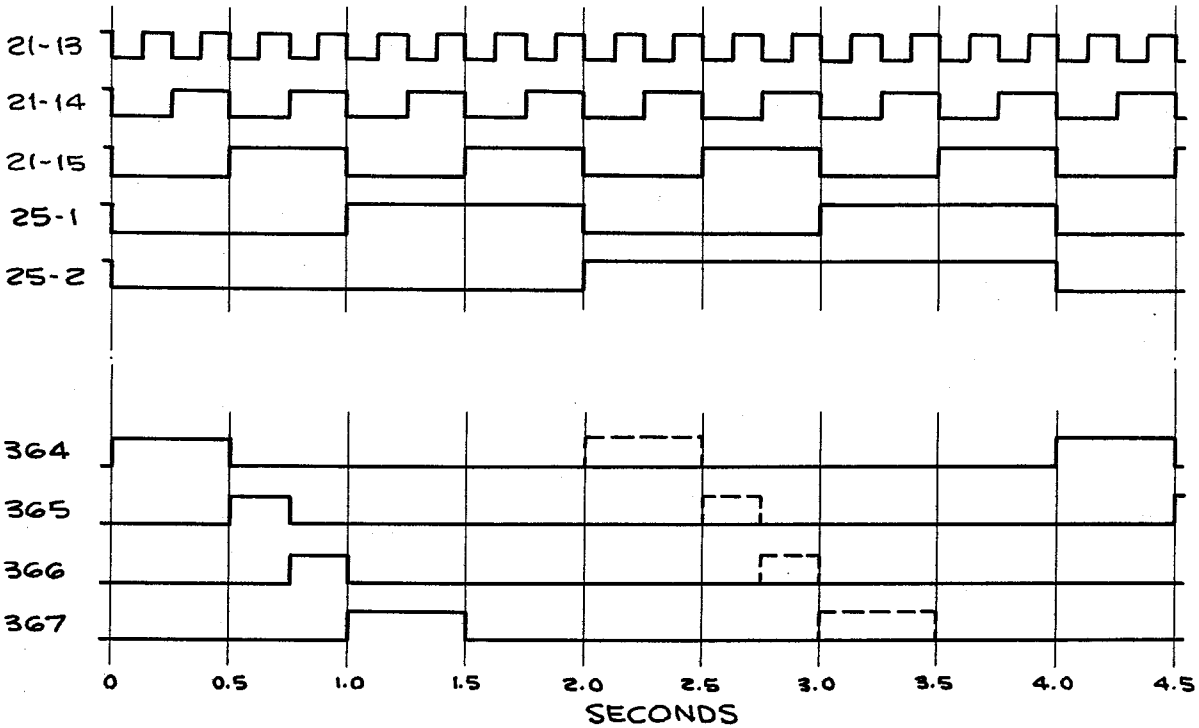
Fig. 4c.
Fig. 4d.
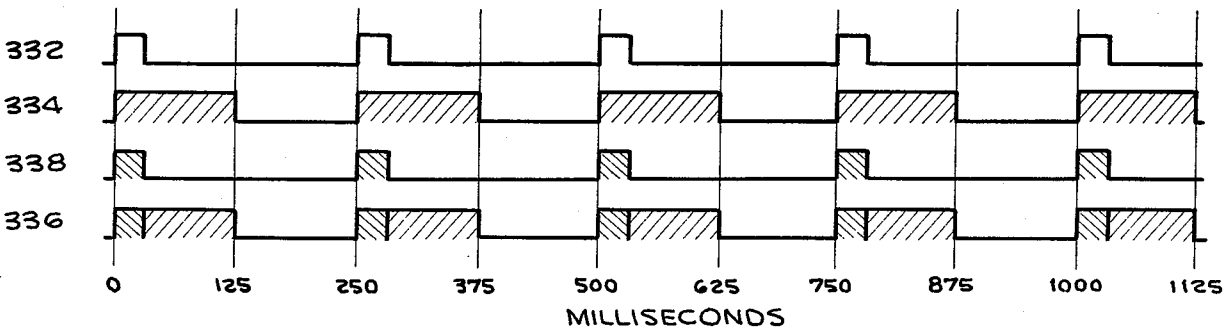
Fig. 4e.

Fig. 10.b
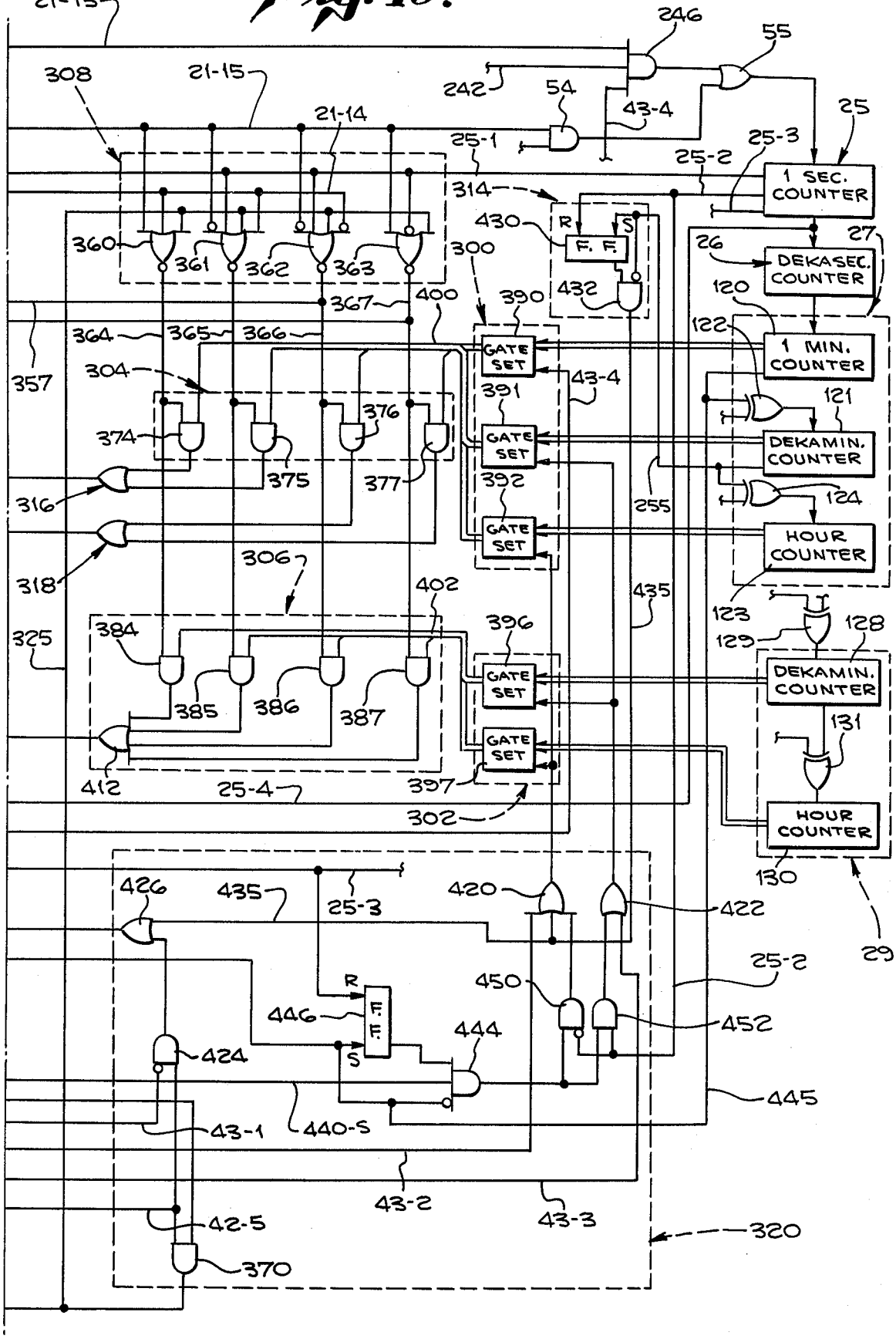

ELECTRONIC WATCH HAVING OPTICAL AND AUDIBLE READOUTS AND ALARM AND STOPWATCH CAPABILITIES

BACKGROUND AND SUMMARY OF THE INVENTION

Electronic timepieces are known having optical displays, readout controls and setting controls, as illustrated for example by U.S. Pat. Nos. 3,672,155 to Bergey et al and 3,810,356 to Fujita, and such timepieces may include an alarm capability, illustrated for example by U.S. Pat. Nos. 3,636,549 to Berman et al, 3,664,116 to Emerson et al, 3,727,395 to Baylor, 3,745,761 to Tsuruishi, and 3,759,029 to Komaki.

The electronic watch of the present invention may provide both optical and audible readout capabilities. In the audible readout mode, the present instrument uses an electroacoustic transducer to produce tone signals, and the transducer desirably takes the form of a small earphone such as is used in a conventional hearing aid or dictating machine. Such a transducer may serve also as the control device or member in the present invention, since it is found that a sharp tap on such a transducer produces a voltage pulse having an amplitude of the order of 1 volt. This is of course many times greater in amplitude than that caused by the loudest sound, and the voltage pulse so produced then serves as a signal for interrogation or control of the present apparatus. Alternatively, the interrogation or control signal may be produced by a pushbutton switch suitably connected to the battery power supply. If no audible readout capability is desired, certain of the circuitry hereinafter shown and described may be eliminated. Even if the audible readout of time is foregone, it may nevertheless be desirable to retain the transducer, in order to provide the alarm capability as well as auxiliary functions performed by such transducer, including an automatic hour strike and an acknowledgment beep occuring immediately after the first interrogating tap by the user, confirming that the tap was sharp enough to generate a voltage of sufficient amplitude to commence operation of the circuitry.

An important feature of the present invention is its use of only a single control member, actuatable by the user, to accomplish the various functions, including an audible readout of clock time, optical readouts of clock time, alarm time and information in an auxiliary register, and the changing of the settings of time and other stored information. Interrogation and control of the timepiece are accomplished by one or more pulses in a pulse train, each pulse being produced by the user's actuation of the control member. The number of pulses in the train, and their chronological spacing within the train, are significant in causing the desired control of the timepiece. In its stopwatch mode, the user may use the timepiece to time events repetitively as desired, and the same electronic counters which are used in the stopwatch mode also serve to store an alarm time selected by the user. Furthermore, the same counters are also used for precision setting of the seconds and minutes of the clock time of the instrument.

The invention also provides security means for minimizing and virtually eliminating the possibility that a random series of control signals might change or otherwise affect any of the settings of the instrument. In the present form of the invention, the security means comprises circuitry which is effectively responsive to a user-produced pulse only during a narrow time gate constituting a short interval — illustratively 0.5 second — immediately following an optical display of longer duration; actuation of the control during the optical display period aborts operation and restores the timepiece to quiescent state.

As used herein, a pulse train is understood to mean a single user-produced pulse or a series of such pulses whose number and chronological spacing are significant in causing the circuitry to respond as desired by the user, either in interrogating a readout or in changing the setting of one or more of the instrument counters.

The optical display desirably includes a seven-segment array for each decimal digit, and the segments may be of the light-emitting diode (LED) type or liquid crystal displays (LCD).

Accordingly, a principal object of the present invention is to provide a novel electronic timepiece. Additional objects are to provide such a timepiece having multiple readout capabilities interrogatable by the user through one of a plurality of predetermined pulse trains consisting of one or more pulses produced by actuation of a single control member; to provide in such a timepiece a stopwatch or duration register providing not only stopwatch capabilities but also used as an alarm register; to provide in such a timepiece means for using the duration register to provide an optical display of changes made during precision setting of the seconds and minutes of clock time, to provide in such a timepiece security means to virtually eliminate the possibility that control signals at random times might adversely affect the various settings of the instrument; and for other and additional purposes as will be understood from the following description of the invention, taken in connection with the accompanying drawings.

BRIEF DESCRIPTION OF THE DRAWINGS

FIG. 10*a* and 10*b*, taken together, show a detailed circuit diagram of the block diagram of FIG. 9.

DETAILED DESCRIPTION

Figures 1, 2:
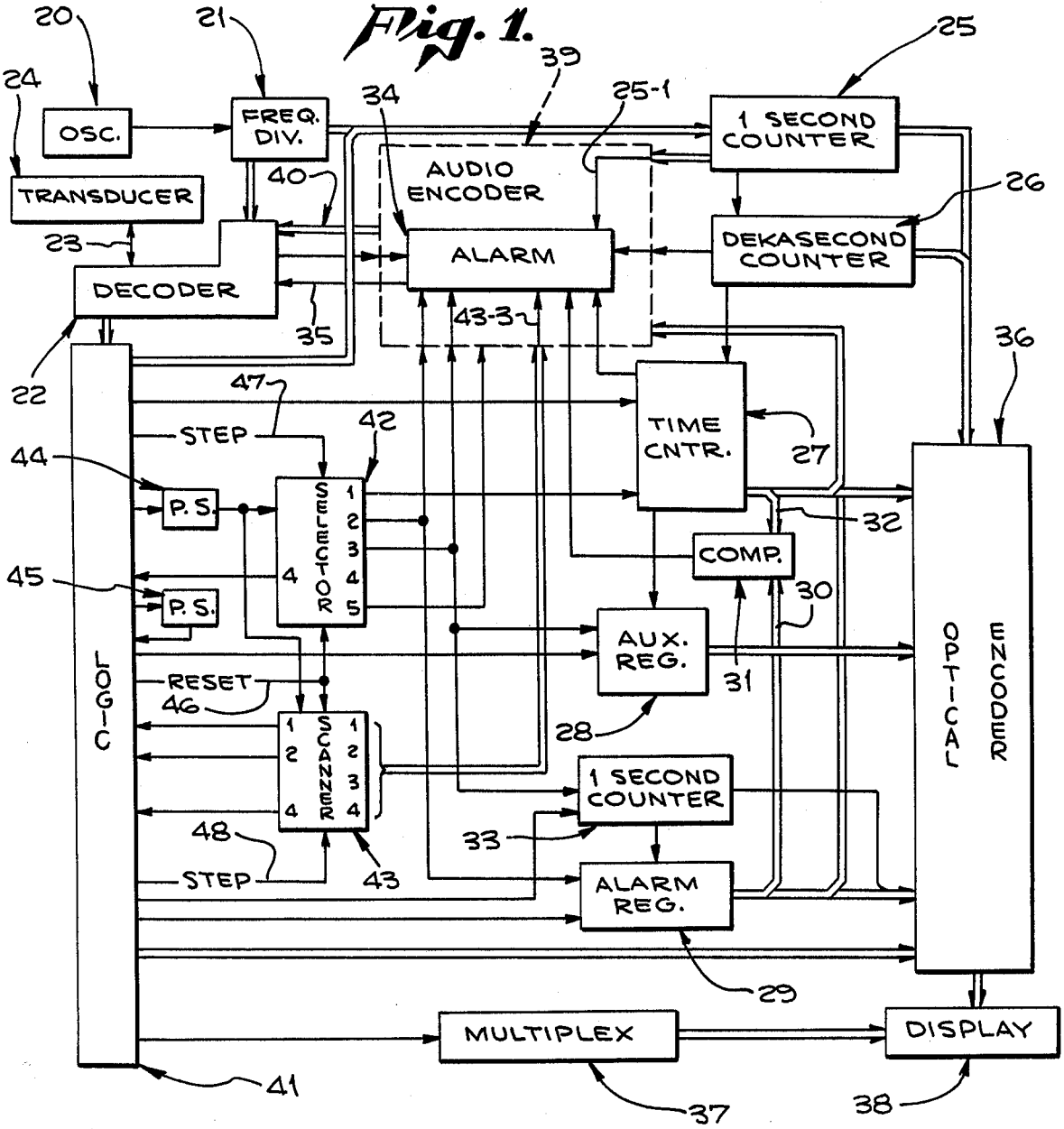
FIG. 1 is a block diagram showing the major components of the preferred embodiment of the present invention; the audio encoder component shown in dotted outline is not used in the optical readout mode, but is used in the audible readout mode.
FIG. 2 is a chart tabulating the functions of the present apparatus for each of the operative positions of the selector and the scanner.

Referring now in detail to the drawings, in FIG. 1 there is shown a block diagram including the major components of an illustrative form of the invention. Each component is indicated generally by a reference numeral, and the diagram includes arrowed lines and cables indicating generally the flow of control and information during operation. For optical readout, to be described in detail in connection with FIGS. 3*a* and 3*b*, the audio encoder shown in dotted outline in FIG. 1 is not used, but it is used for the audible readout mode to be described in connection with FIGS. 9, 10*a* and 10*b*.

Thus an oscillator 20, illustratively having a frequency of 32,768 Hz, the fifteenth power of 2, drives a frequency divider 21 of conventional design, such as a chain of binaries, for providing outputs to a decoder 22. The outputs are used for timing signals as well as tone signals in the audible range. The tone signals are fed by the decoder via line 23 to transducer 24, which may be of the type as those used in earphones of hearing aids, portable radios, dictating equipment and the like. As indicated by the two arrows on line 23, the transducer is also used to transmit one or more signals to the decoder for interrogation and control of the present circuitry, each of such signals being in the form of a relatively large voltage pulse, having a magnitude of the order of 1 volt, created by the wearer's sharply tapping the transducer with his finger. Frequency divider 21 also feeds timing information to a 1-second counter 25 which, via dekasecond counter 26, feeds a clock time counter 27, which in turn feeds an auxiliary register 28. This register may be used, for example, to store the month and date or other desired information.

An alarm register 29 has stored therein a time, accurate to 10 minutes, at which the user wishes an alarm to sound. The alarm register and time counter 27 feed their information to comparator 31 via respective cables 30 and 32. When the comparator indicates that the clock time has arrived at the time stored in the alarm register, the comparator furnishes a signal to the alarm circuit 34. If the user has armed the alarm, alarm circuit 34 feeds an alarm signal to decoder 22 via line 35, and the decoder then feeds an alarm tone signal via line 23 to transducer 24. A 1-second counter 33 serves in conjunction with alarm register 29 to provide the stopwatch capability of the apparatus.

The counters and registers above mentioned all feed their outputs to an optical encoder 36, which in conjunction with multiplex 37, produces a readout in display 38.

In addition to the optical readout capability briefly outlined above, the present invention contemplates the provision of an audible or audio readout. In the audio readout mode, alarm circuit 34 as such is not used, but its functions along with additional audio functions are performed by audio encoder 39, which receives information from many of the components, as indicated by the arrowed lines, and feeds via cable 40 audio control information to decoder 22, which feeds audio signals via line 23 to transducer 24 for the audio readout.

All of the readouts, as well as settings of time counter 27, auxiliary register 28 and alarm register 29, are accomplished by the user through logic circuitry 41, selector 42 and scanner 43. In the initial phase of each readout interrogated by the user, logic circuitry 41 energizes a first power supply 44 and, shortly thereafter, a second power supply 45. As will be understood, this sequential energizing of the power supplies is desirable in order to prevent an inadvertent change in the settings of any of the counters or registers in the present apparatus.

Thus, power is constantly supplied to all components shown in FIG. 1 except selector 42, scanner 43 and certain elements of logic 41. More particularly, as will be described in connection with FIGS. 3*a* and 3*b*, power is constantly supplied only to the following elements of logic 41, listed here for convenience: flipflops 56, 61, 73 and 96, and gates 58, 59, 67, 68, 71 and 72. A tap-produced pulse first turns on power supply 44, which energizes selector 42 and scanner 43. Several milliseconds later logic 41 produces a signal in line 46 which resets the selector and scanner to their first positions. Another few milliseconds later logic 41 energizes power supply 45, which furnishes power to the rest of the logic circuitry. Logic circuitry 41 is also adapted to furnish stepping signals via lines 47 and 48 to selector 42 and scanner 43.

Selector 42 and scanner 43 is each a stepping switch for energizing only one of its numbered outputs at any one time. The reset signal in line 46 returns the selector and scanner to their respective first positions. As indicated in FIG. 2, the first position of the scanner does not correspond to any interrogated readout. The scanner is stepped to its second and later positions only after the user has chosen, by one or more properly timed initial taps, the selector position to produce the readout he wishes. Thus, a single initial tap generates a voltage pulse which leaves selector 42 at its first position and, after approximately 1-second, logic 41 commences an optical readout cycle of clock time. If the user instead wishes an optical readout of the time stored in alarm register 29, then he must tap the transducer a second time within approximately 1-second after the first tap; the second voltage pulse so generated steps the selector 42 to its second position and, after approximately 1-second, logic 41 commences an optical readout relating to the time stored in alarm register 29. In similar manner, by one or more additional taps, each following the preceding tap by an interval of less than approximately 1-second, the user can step selector 42 to its third, fourth, or fifth positions, and the present apparatus will then produce a readout of the corresponding information shown in the chart of FIG. 2. As there indicated, the first four selector positions produce optical readouts, while the fifth position produces an audio readout. This last will be described in detail in connection with FIGS. 9, 10*a*, and 10*b*.

SELECTOR POSITION 1 — OPERATION SUMMARY

More specifically, in the simplest situation, let it be supposed that the user wishes the apparatus to produce an optical readout of the time. The following events occur:

A. The user taps transducer 24, thus producing a voltage pulse in line 23 fed to decoder 22, which feeds a signal to logic 41 energizing power supply 44.

B. Within a few milliseconds, decoder 22 starts to feed an 8 ms. acknowledgment signal via line 23 to transducer 24, producing a 4 kHz acknowledgment beep, thus informing the user that his tap was sufficiently sharp to generate a response from the circuitry; and simultaneously logic 41 resets selector 42 and scanner 43 by a signal in line 46.

C. A few milliseconds later, logic 41 energizes power supply 45.

D. Within less than 2-seconds, logic 41 furnishes a stepping pulse signal on line 48 to step scanner 43 to its second position.

E. Logic 41 then enables optical encoder 36, which receives clock time information from time counter 27, to furnish time signals to display 38, and logic 41 simultaneously energizes multiplex 37 to display clock time.

F. As will be described later in connection with waveform 90 of FIG. 4*b*, the present illustrative form of the invention provides a two second display cycle, including a 1.5 second display-on period and a 0.5 second display-off interval. Thus the display of time normally remains on for 1.5 seconds, but the user can turn it off during the display-on period by a tap on the transducer, which de-energizes power supplies 44 and 45. If he does not so tap, then during the following 0.5 second display-off interval the user can tap the transducer and thereby initiate additional control, described below. If the user does not so tap, the apparatus will turn itself off at the end of the two second display cycle.

Having seen the displayed time, the user can change the hours or dekaminute digit or both by proceeding as follows:

G. During the 0.5 second interval immediately following the 1.5 display period, the user taps the transducer once. The resulting pulse causes the same time display to be shown again for the rest of the 0.5 second interval and for the following 1.5 second display period.

H. During the 0.5 second interval following the second display-on period, the user again taps the transducer. The resulting pulse steps scanner 43 from its second position to its third position, causing the apparatus to display for 1.5 seconds only the dekaminute digit of the time.

I. If the user wishes to change the dekaminute digit, he taps the transducer once during the 0.5 second interval following the 1.5 second display of that digit. The resulting pulse causes the apparatus to start advancing the dekaminute digit at the rate of 1-dekaminute per second. The advancing digit will be shown in the display, and will also be stored in the appropriate portion of time counter 27. When the user sees that the advancing digit has arrived at the correct number of dekaminutes, he again taps. The resulting pulse stops the advancing of the displayed and stored digit, and also steps scanner 43 to its fourth position.

J. If the dekaminute digit originally displayed was correct and the user accordingly does not wish to change that digit, then the user does nothing during the entire 2-second display cycle of the dekaminute digit. At the end of that display cycle, logic 41 steps scanner 43 to its fourth position.

K. Scanner 43 having thus been stepped to its fourth position, the apparatus displays for 1.5 seconds only the number of hours of the time. If the number so displayed is correct and the user accordingly does not wish to change it, the user does nothing during the entire two second display cycle of the number of hours. At the end of the display cycle, the apparatus automatically turns itself off by deenergizing power supplies 44 and 45. But if the user wishes to correct the number of hours, he proceeds as in the case of correcting the dekaminute digit as described in paragraph I above.

L. Specifically, he taps the transducer during the 0.5 second interval following the 1.5 second display-on period of the number of hours. The resulting pulse causes the apparatus to start advancing the number of hours at the rate of 1-hour per second. The advancing number will be shown in the display, and will also be stored in the appropriate portion of time counter 27. When the user sees that the advancing number has arrived at the correct number of hours, he again taps. The resulting pulse stops the advancing of the number of hours displayed and stored, and also causes the apparatus to turn itself off by deenergizing power supplies 44 and 45.

Operation of the present apparatus in obtaining an optical readout of the time stored in the alarm register 29 and in changing the dekaminutes and hours stored therein is accomplished in substantially the same way as just described in connection with the display and setting of the hours and dekaminutes of the clock time in time counter 27, except that the user's initial interrogation consists of two taps, the interval between the two taps being no more than 1-second. The second of the two voltage pulses so generated steps the selector to its second position and, after approximately 1-second, the hours and dekaminutes stored in the alarm register 29 will be displayed for a period of 1.5 seconds. From this point on, display and setting of the hours and dekaminutes stored in the alarm register follow the same procedure as previously described in connection with display and setting of clock time hours and dekaminutes when the selector 42 is at its first position. It may be noted that such cycling through of the alarm displays will cause the alarm to be armed. As will be later shown, if the user initially taps more than twice, in order to step selector 42 to its third, fourth of fifth position, the alarm will be disarmed; in order to rearm it, it would then be necessary to cycle through the alarm displays.

The user can abort operation by tapping the transducer during any one of the 1.5 second display periods mentioned above. The voltage pulse so generated will cause the logic circuitry 41 to turn off the apparatus by deenergizing power supplies 44 and 45. By the same token, any voltage pulse from transducer 24 resulting from an inadvertent striking of the transducer against a hard object, or from dropping it, will almost certainly cause nothing more serious than an unnecessary readout. Changing of any of the settings of the apparatus can be accomplished only after a tap has occurred during each of two 0.5 second display-off intervals. Thus the narrow 0.5 second time gates and the longer 1.5 second abort periods make it almost impossible that a random series of taps or jolts of the transducer would effect a change in the settings of the time counters or of the registers.

The third and fourth positions of selector 42 provide other displays and controls in the optical readout mode, as indicated in the chart of FIG. 2. These are somewhat more complex than the operations in the first and second positions of selector 42, and will be described hereinafter in connection with FIGS. 3*a* and 3*b*, to be now described in detail.

DECODER AND LOGIC

Figure 9:
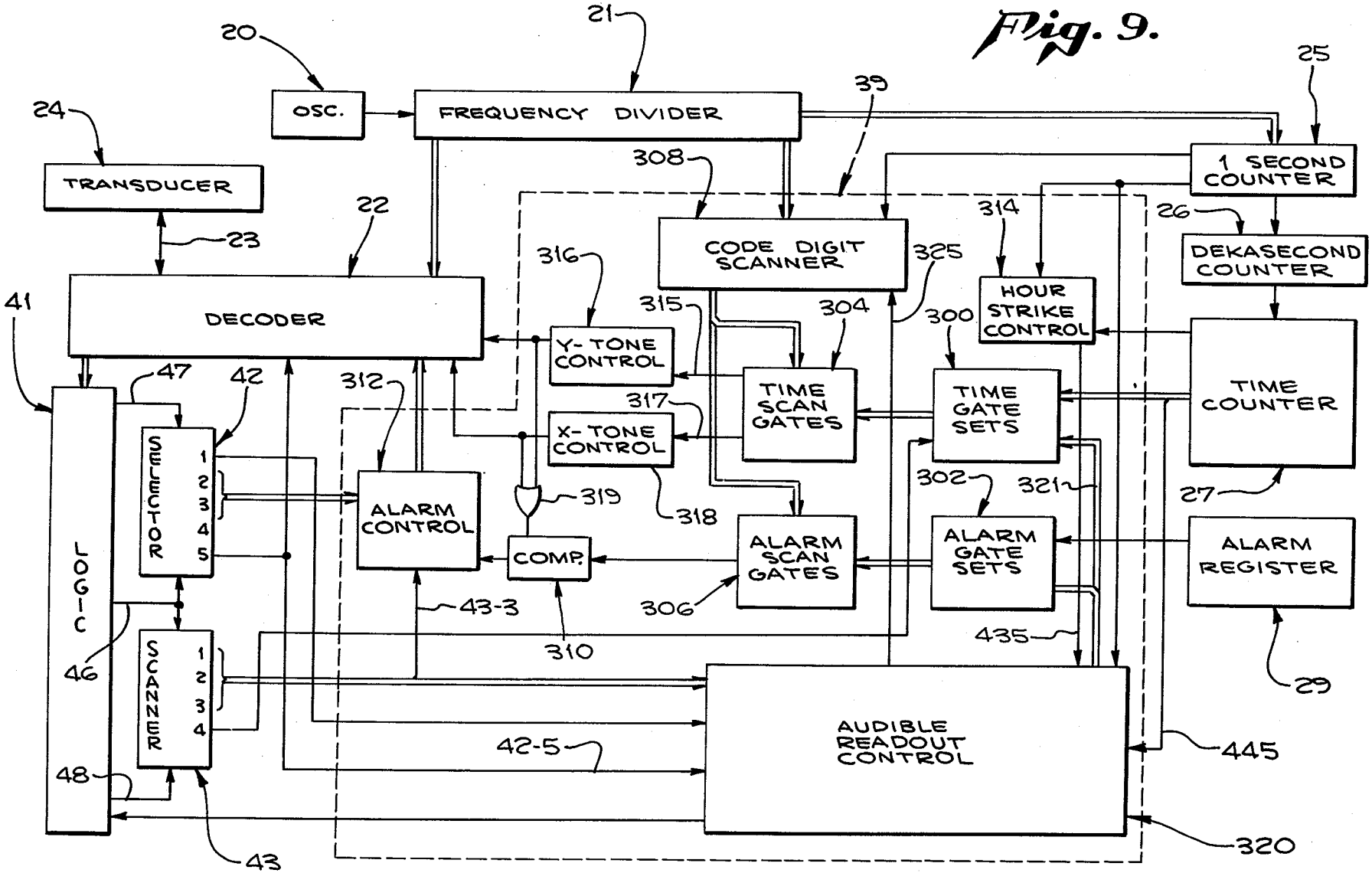
FIG. 9 is a block diagram of major components used in the audible readout mode of the present invention.
Figure 10A:
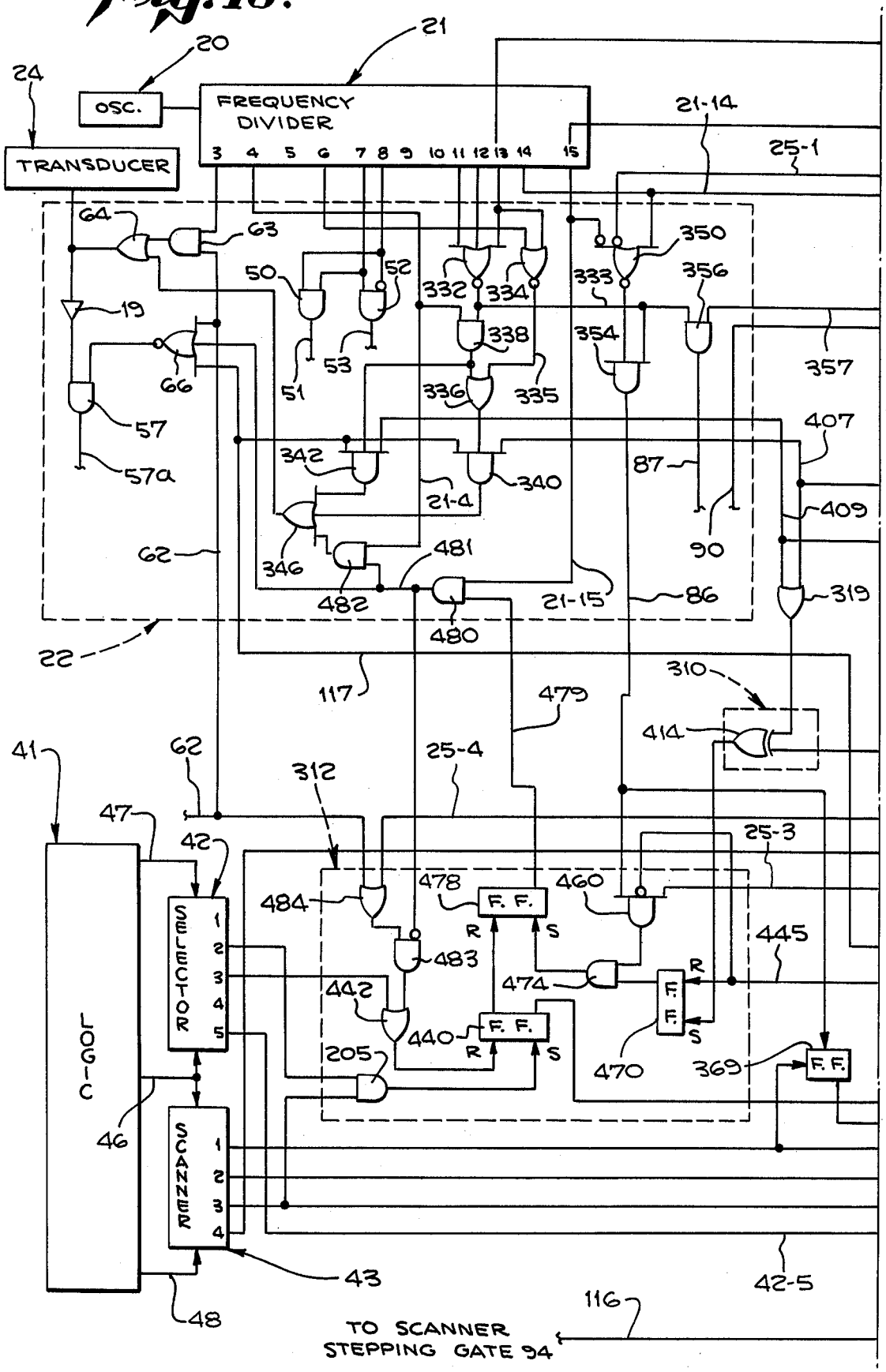

Decoder 22 shown in FIG. 1, as well as in FIGS. 9, 10*a* and 10*b*, is adapted to function in both the optical and the audio readout modes in accordance with the invention. In the interest of clarity of explanation of the circuitry of FIGS. 3*a* and 3*b*, a simplified form of decoder is therein indicated generally at 22*a*, and is adapted to function only in the optical readout mode.

Figure 3A:
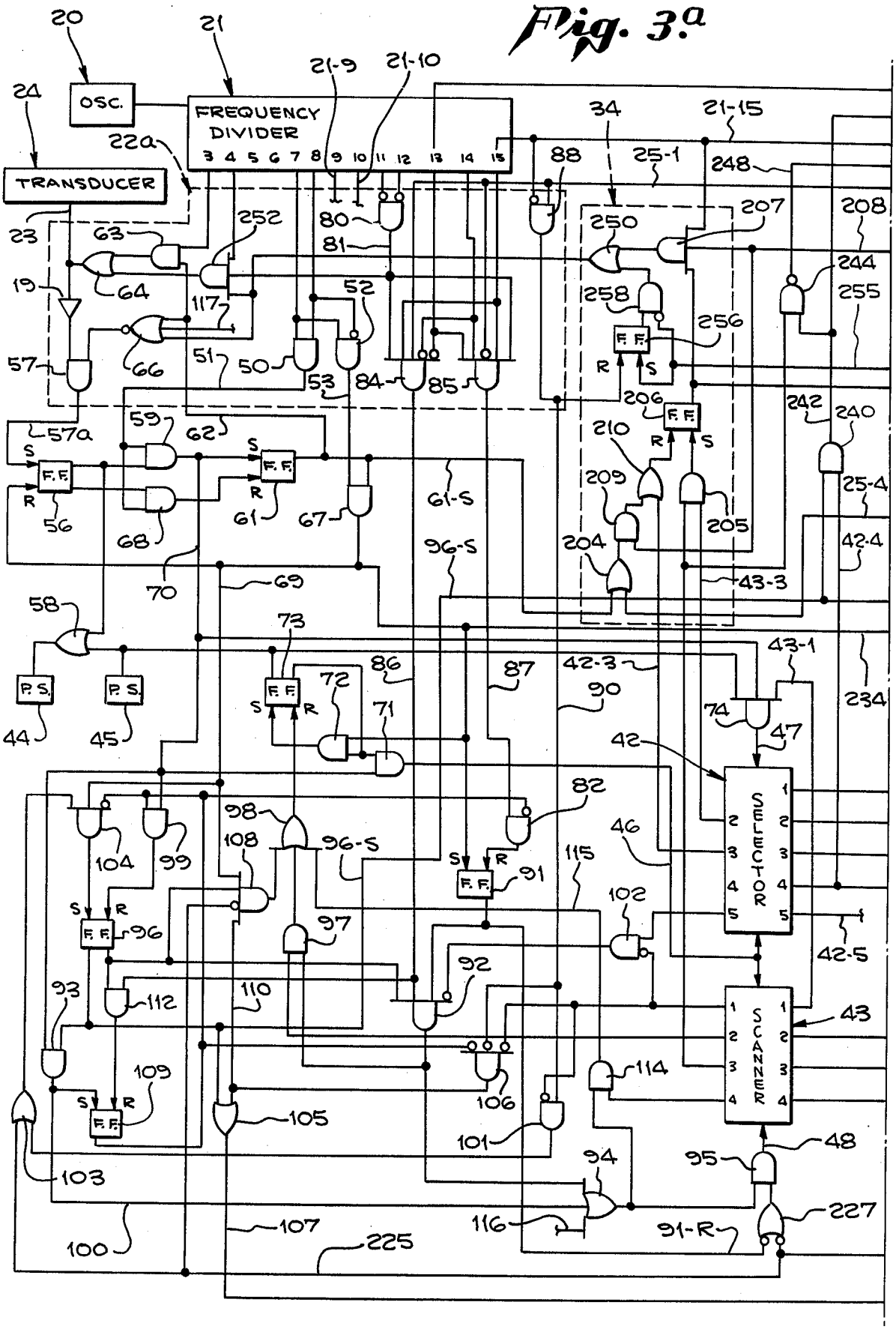
FIG. 3*a* and 3*b*, taken together, show a detailed circuit diagram of the components of FIG. 1 in the optical readout mode.
Figure 3B:
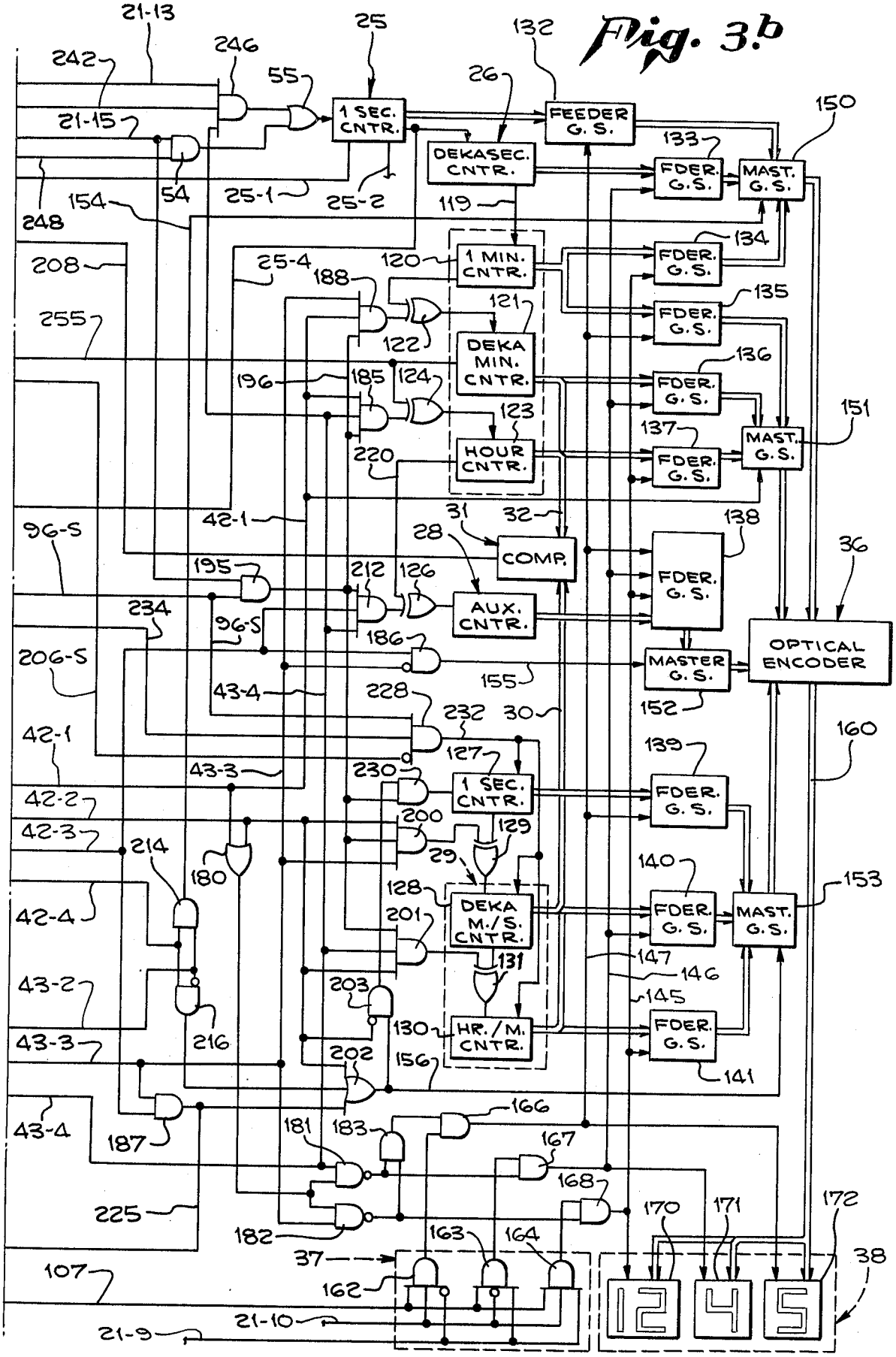
Figure 4A:
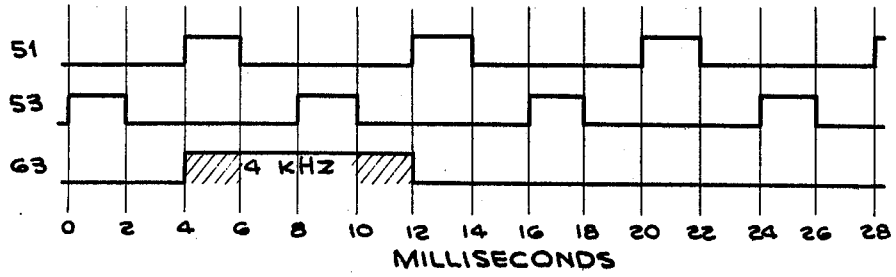
FIG. 4 shows in its subdivisions waveforms for certain parts of the circuitry of FIGS. 3*a*, 3*b*, 10*a* and 10*b*.

In FIGS. 3*a* and 3*b*, frequency divider 21, driven at 32,768 Hz by oscillator 20, includes 15 binary stages. The outputs of the first and second stages are not indicated, since those outputs are not used in the circuitry. The third and fourth stages of frequency divider 21 provide tone signals of frequencies of approximately 4 kHz and 2 kHz respectively (actually 4.096 and 2.048 kHz, as will be readily understood); and the other stages of the frequency divider from which output lines extend in FIG. 3*a* provide timing signals. Thus the signals from the seventh and eighth stages are combined as indicated in AND gates 50 and 52 to provide output signals in lines 51 and 53 respectively, the waveforms being shown in FIG. 4*a*. Under typical conditions, the output of the fifteenth stage of frequency divider 21 drives a 1-second counter 25 through normally enabled AND gate 54 and OR gate 55. Under conditions of changing settings by advancing the time at a multiple rate, the output of the thirteenth stage of the frequency divider may also, as will be described later, drive 1-second counter 25. FIG. 4*c* shows the waveforms of the thirteenth, fourteenth and fifteenth stages of frequency divider 21 at 21-13, 21-14 and 21-15, and of the 1st and 2nd stages of counter 25 at 25-1 and 25-2.

To obtain a display of time, the user taps transducer 24 to produce in line 23 a pulse which will have a magnitude of the order of 1 volt. This signal, amplified if desired by amplifier 19, is fed via normally enabled AND gate 57 to the set input of flipflop 56, whose set output, via OR gate 58, energizes power supply 44 and also enables AND gate 59. Thus the next timing pulse on line 51 sets flipflop 61 which, via line 62, enables gate 63 to pass an acknowledgment beep via OR gate 64 to transducer 24. The beep, marked 63 in FIG. 4*a*, is a 4 kHz tone lasting 8 ms. Thus gate 64 carries several milliamperes. The set output of flipflop 61, via NOR gate 66, disables gate 57, so that the beep signal will not hold flipflop 56 set. The set output of flipflop 61 also enables AND gate 67, so that the next timing signal on line 53 resets flipflop 56 via line 69, thus enabling AND gate 68. Thereafter, the next timing signal on line 51 resets flipflop 61 via gate 68, thereby terminating the acknowledgment beep. The timing signal in line 51, via gate 59, also resets both selector 42 and scanner 43 via line 70, enabled AND gate 71 and line 46. The signals in line 69 and 70 also perform other functions, described below.

Timing signal 53, in addition to resetting flipflop 56 as stated above, also sets flipflop 73 via gate 67 and enabled AND gate 72, thereby energizing power supply 45, thus supplying power to all of the remaining components of the circuitry. The set output of flipflop 73 also, via gate 58, keeps power supply 44 energized regardless of subsequent resetting of flipflop 56. Hence flipflop 73 may be thought of as a master control for the system; when reset, it deenergizes the power supplies. The set output of flipflop 73 also enables AND gate 74, whose output in line 47 steps selector 42. This gate 74, as will be observed, is already prepared by the output of the first position of scanner 43 in line 43-1. Hence, if the user taps transducer 24 a second time while scanner 43 is still on its first position, the resulting voltage pulse will set flipflop 56 and thus enable gate 59, so that the next succeeding timing signal in line 51 will step selector 42 to its second position via gate 59, line 70 and gate 74. In this manner, as long as master flipflop 73 remains set, and as long as scanner 43 remains on its first position, subsequent pulses in line 70 from tap-generated voltages will step selector 42 to its third, fourth or fifth positions. As will be seen, unless a subsequent tap-initiated pulse follows an earlier tap-initiated pulse by a time interval of no more than approximately 1 second, scanner 43 will have been stepped from its first position to its second position by circuitry to be now described, thereby preventing, during that particular cycle of the scanner, subsequent stepping of selector 42 from whatever position it has assumed as a result of the initial tap or initial series of taps.

The ninth and tenth stages of divider 21 provide timing signals to multiplex 37 as will be described later, the connecting lines being omitted to avoid cluttering the drawing. AND gate 80 receives the indicated inputs from the eleventh and twelfth divider stages and produces a timing signal in line 81 having a waveform shown in FIG. 4*f*. The signal in line 81, together with the indicated outputs of the thirteenth, fourteenth and fifteenth stages of the divider and the output signal in line 25-1, is fed to AND gates 84 and 85, whose output signals in respective lines 86 and 87 have the waveforms shown in FIG. 4*b*. The inverted output of the fifteenth stage of the frequency divider and the signal in line 25-1 are fed to AND gate 88, whose output signal in line 90 has a waveform shown in FIG. 4*b*, providing a 2.0 second display cycle including a 1.5 second display-on period followed by a 0.5 second display-off interval.

Figure 4B:
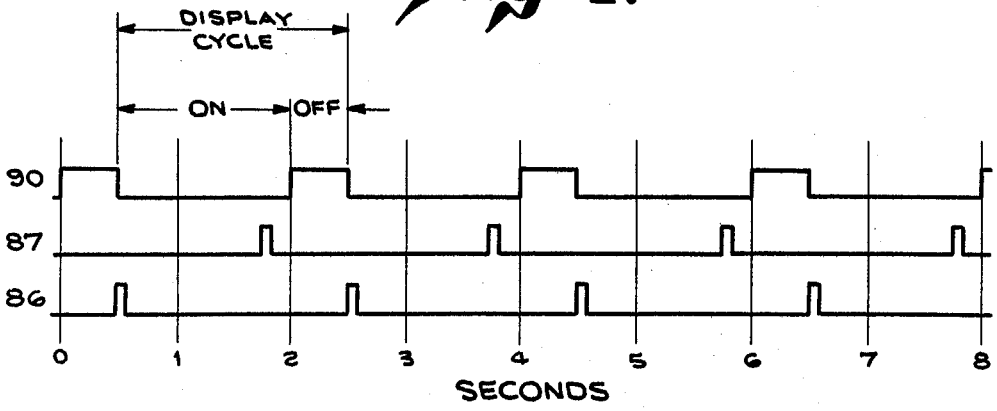
Figures 4F, 4G, 4H:
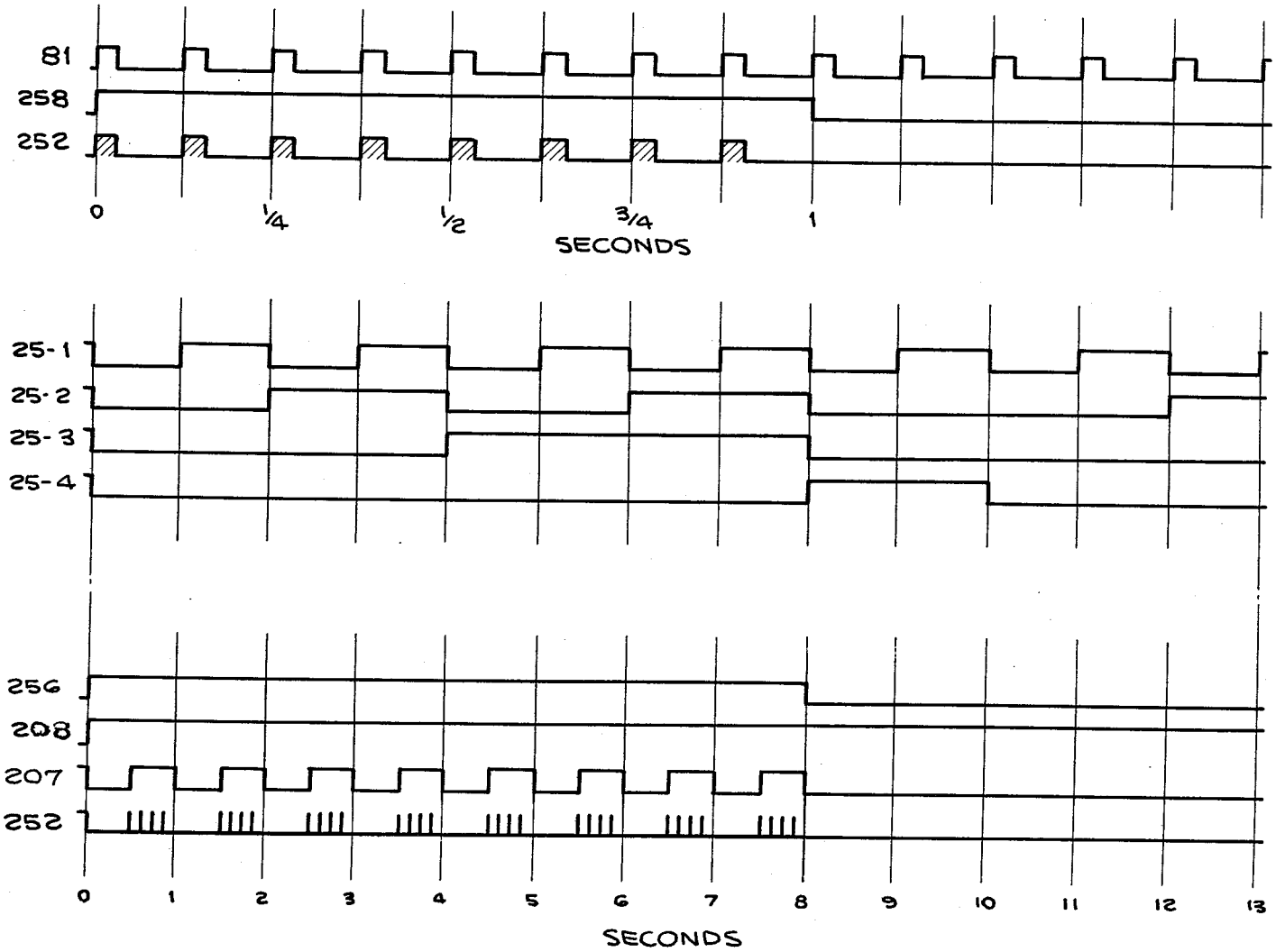

The pulse signals in lines 86 and 87, each occurring every 2 seconds in alternating relation as indicated in FIG. 4*b*, in addition to performing other functions, control the periodic stepping of scanner 43, the signal in line 86 being the actual stepping pulse. Every two seconds the pulse in line 87 is applied to AND gate 82. If that gate is enabled in a manner described below, the pulse resets flipflop 91, which can be set only by a tap-originated pulse from gate 67 via line 69. The reset output of flipflop 91, among other functions, enables AND gate 92. Assuming that, for reasons later discussed, gate 92 is also enabled by the reset output of flipflop 96, the next pulse in line 86 steps scanner 43 to its second position via OR gate 94 and typically enabled AND gate 95. As indicated in FIG. 2, this displays the time by initiating the 2 second display cycle of signal 90 previously mentioned and shown in FIG. 4*b*. Unless a tap-originated pulse sets flipflop 91 and thus disables gate 92, and assuming for reasons later discussed that flipflop 96 is reset so that its reset output continues to enable gate 92, it will be seen that the subsequent pulse in line 86 will step scanner 43. However, in stepping the scanner from its second position, since AND gate 97 is then enabled by the signal in line 43-2, the stepping pulse 86 from gate 92 will also, via gate 97 and OR gate 98, simultaneously reset master flipflop 73, thereby aborting the operation by deenergizing power supplies 44 and 45 (compare par. F of the above Operation Summary). As will be later seen, effective stepping of scanner 43 to its third position can be accomplished only by a properly timed tap-originated pulse from gate 59 via line 79, AND gate 93 (enabled by the set condition of flipflop 96), line 100, and gates 94 and 95.

The signal in line 90 is a major element of control of multiplex 37 and thus of display 38, the polarity of signal 90 being such, as indicated in FIG. 4*b*, that the display is turned off during the 0.5 second positive pulse interval following the 1.5 second display-on period of signal 90. As further shown in FIG. 4*b*, the scanner stepping pulse 86 occurs immediately after each 0.5 second display-off interval of signal 90.

With reference to the subcircuit including gate 59, flipflop 61 and gate 67, it will be noted that the output pulse in line 69 from gate 67 caused by a given tap on the transducer lags in phase several milliseconds behind the output pulse in line 70 from gate 59 caused by the same tap. This phase lag is important in certain aspects of the operation of the present apparatus, and accordingly the pulse in line 70 may be referred to herein as the first phase pulse, the pulse in line 69 being correspondingly referred to as the second phase pulse.

After pulse 86 steps the scanner to its second position, the resulting absence of signal in line 43-1, inverted, enables AND gates 101, 102 and 106. The next 0.5 second display-off signal on line 90 fed to enabled gate 101 goes via OR gate 103 to enable AND gate 104. Let it be assumed, for reasons later discussed, that gate 104 is further enabled by the reset condition of flipflop 109, and that flipflop 96 is reset, thus disabling gate 93. If now the user taps the transducer during the 0.5 second interval, the first phase pulse in line 70, fed to disabled gate 93, will be nugatory, but the second phase pulse in line 69 will set flip-flop 96. The set output of flipflop 96 in line 96-S turns on display 38 via OR gate 105 and line 107 (compare par. G of the Operation Summary), and also enables gate 93. Thus a pulse from a subsequent tap from gate 59 via line 70 to gate 93 will set flip-flop 109, thereby disabling gate 104 and enabling gate 99.

Each second phase pulse of the tap-initiated signals just mentioned will set flipflop 91 via line 69, thereby disabling AND gate 92, and thus preventing the next timing signal on line 86 from stepping the scanner. The next timing signal on line 87 will reset flipflop 91, thereby enabling gate 92, so that a subsequent timing signal on line 86 may step the scanner, depending on whether flipflop 96 is reset, thus further enabling gate 92.

It will be noted that the reset output of flipflop 96 prepares AND gate 108 so that, while gate 108 is enabled by a display-energizing signal from gate 106 via line 110, a tap-initiated pulse will abort system operation by resetting master flipflop 73 via gate 67 line 69 and gates 108 and 98. The reset output of flipflop 96 also enables AND gate 112, so the next pulse on line 86 will reset flipflop 109.

A tap-originated pulse during the 0.5 second display-off interval of signal 90 does not abort circuit operation, but does enable gate 92 by resetting flipflop 96, so that the next stepping pulse on line 86 will step scanner 43 from its third position to its fourth, or from its fourth back to its first. However, in the last instance, the signal in line 43-4 enables AND gate 114, so that the stepping pulse from gate 94 is fed via line 115 and gate 98 to terminate operation by resetting master flipflop 73.

OR gates 94 and 66 have respective input lines 116 and 117 not referred to heretofore. They are used only in the audio mode, and will be described in connection with FIGS. 9, 10*a* and 10*b*. The same applies to line 42-5 from selector 42, as well as to line 25-2 from the second stage of 1 second counter 25.

ACTUATION OF DISPLAYS

With reference now primarily to FIG. 3*b*, the circuitry and components will be described for actuating the display 38. One-second counter 25 feeds a pulse every 10 seconds to dekasecond counter 26. Within time counter 17 a 1 minute counter 120 receives a pulse once per minute from counter 26 via line 119 and feeds a dekaminute counter 121 via EXCLUSIVE OR gate 122. Counter 121 feeds an hour counter 123 via EXCLUSIVE OR gate 124. The hour counter, via EXCLUSIVE OR gate 126, feeds auxiliary counter 28. The one-second counter previously indicated generally at 33 is here specifically indicated at 127. Within alarm register 29 a dekaminute/dekasecond counter 128 is fed by counter 127 via EXCLUSIVE OR gate 129, and the latter counter feeds an hour/minute counter 130 via EXCLUSIVE OR gate 131.

Each of the counters just mentioned continuously supplies coded information of the numbers stored therein to one of the feeder gate sets 132–141, as indicated, there being two feeder gate sets, 134 and 135, receiving identical information from 1 minute counter 120, for reasons discussed later. The feeder gate sets are repetitively sequentially enabled by signals in lines 145, 146 and 147, as produced by multiplex 37 in a manner described below. Each has a frequency — here illustratively 32 Hz — high enough to prevent visible flicker in display 38.

When so enabled by the appropriate one of the signals 145–147, each feeder gate set passes its received information to the indicated one of master gate sets 150–153. Each of the master gate sets, only one of which is enabled at any one time, when enabled by a signal in its respective enabling line 154, 42-1, 155 or 156, supplies its received information to optical encoder 36 which, via its output cable 160, supplies to display 38 driving signals corresponding to its received coded information, in a manner well known in the art and shown, for example, in U.S. Pat. No. 3,707,071 to Richard Walton.

Multiplex 37 receives timing signals from the ninth and tenth stages of frequency divider 21 on lines 21-9 and 21-10 (the connecting lines being omitted in the drawing) as well as a display-on signal in line 107. These three signals are fed to AND gates 162, 163 and 164 of the multiplex in the manner shown, the signals in lines 21-9 and 21-10 being inverted in being applied to gates 162 and 163 respectively. When line 107 is energized by gate 105, gates 162-164 feed AND gates 166-168 respectively, and the latter gates, when enabled according to one or another of the functional modes of the invention, produce output signals in lines 145-147. These signals, in addition to enabling the indicated feeder gate sets 132-141, also enable the respective hour, dekaminute and minute portions 170, 171 and 172 of display 38, as shown. In the illustrative time of 12:45 in the display, the hours digits "12" will be illuminated during the 1/128 second period when portion 170 is energized by the positive value of the signal in line 145. Similarly, the dekaminute digit "4" in display portion 171 will be illuminated during the 1/128 second period of the positive value of signal 146, and the minute digit "5" during the 1/128 second period of signal 147.

As will be later described, in the stopwatch mode the display of 12:45 would indicate an elapsed time of 12 minutes and 45 seconds. Otherwise stated, in the stopwatch mode the elapsed dekaminute and minutes are shown in display portion 170, the elapsed dekaseconds are shown in portion 171, and the elapsed seconds are shown in portion 172.

FIRST POSITION OF SELECTOR

As previously described, the user starts an optical time readout by making a single interrogating tap on the transducer. The resulting functioning of the logic circuit of FIG. 3*a* has been described above. Referring now to FIG. 3*b*, the signal in line 42-1, via OR gate 180, enables NAND gates 181 and 182, whose outputs directly control gates 167 and 168 respectively and, via AND gate 183, control the gate 166. The signal in line 42-1 also enables master gate set 151, as well as AND gates 185 and 188 for the setting function described below.

When the stepping signal in line 86 steps scanner 43 to its second position, the output signal in line 43-2 is not fed to either of NAND gates 181 and 182, so gates 166–168 remain enabled. Accordingly, during the 1.5 second display-on period of signal 90, the entire clock time in counters 120, 121 and 123 will appear in display 38 (compare par. F of the Operation Summary).

When the user steps scanner 43 to its third position by two spaced taps as previously described, the signal in line 43-3 is fed to gate 182, thus disabling gate 168 directly and, by disabling gate 183, also disabling gate 166. The signal in line 43-3 also disables AND gate 186, and enables AND gates 187 and 188. Accodingly, since gates 166 and 168 are disabled, only gate 167 is operative, so only the dekaminute digit "4" appears in the display during the 1.5 second display-on period of signal 90. If the user wishes to change the digit (compare par. I of the Operation Summary), he taps the transducer once during the following 0.5 second display-off interval. The resulting pulse from gate 67 sets flipflop 96 whose set output in line 96-S enables AND gate 195 to pass the 1 Hz pulses of line 21–15 via line 196 to gate 188, already enabled by the signals in lines 42-1 and 43-3, and via gate 122 to dekaminute counter 121. Each of the 1 Hz pulses advances the dekaminute digit in counter 121 by one, and the advancing digit appears in display portion 171. When the user sees the correct digit appear, he taps the transducer. The resulting first phase pulse in line 70, via enabled gate 93, sets flipflop 109, thereby disabling gate 104 and enabling gate 99 to pass the first phase pulse in line 70 to reset flipflop 96. Simultaneously with setting flipflop 109, the first phase pulse steps the scanner to its fourth position via line 100.

This stepping of the scanner to its fourth position disables NAND gate 182 and enables NAND gate 181, so that gates 166 and 167 are disabled and gate 168 is enabled. As a result, only the number of hours in display portion 170 will appear during the subsequent display-on period of signal 90. Also, gate 188 is no longer enabled, but gate 185 is enabled by the signal in line 43-4.

After the scanner is so stepped to its fourth position, the next display-on period of signal 90 will produce a signal in line 107 to energize multiplex 37 and thus illuminate the display portion 170 so the number of hours is shown. As in the case of the dekaminute digit just described, the user can change the number of hours by tapping the transducer once during the following 0.5 second interval, which applies the 1 Hz pulses in line 196 to hour counter 123 via gate 185. When he sees the correct number of hours displayed in portion 170, he stops the advancing number by a tap on the transducer. The resulting pulse from gate 59 via line 70 and gate 99 resets flipflop 96 and also, via gate 93 and line 100, steps the scanner from its fourth position. Since gate 114 is enabled, the stepping pulse from gate 94 also terminates operation by resetting master flipflop 73 via line 115 and gate 98.

If the user does not wish to change the number of hours originally displayed, he of course does not tap the transducer during the 0.5 second display-off interval. The next pulse in line 86 then steps the scanner via gate 92, and simultaneously terminates operation via gate 114.

SECOND POSITION OF SELECTOR

Optical readout of the time stored in alarm register 29, and changing of the dekaminute digit and the number of hours therein, are accomplished in substantially the same manner as just described for the corresponding functions of time counter 27. Of course, the user originally interrogates the apparatus by two taps on the transducer spaced by no more than approximately one second. The second of those taps steps selector 42 to its second position, and the resulting signal on line 42-2 enables AND gates 200 and 201 and, via OR gate 202 and line 156, master gate set 153. The inverted signal in line 42-2 disables AND gate 203, whose function is described below in connection with operations when the selector is in its third and fourth positions.

As seen in FIG. 3*a*, the signal in line 42-2 enables AND gate 205 so that, if the scanner reaches its third position, the resulting signal in line 43-3 will set flipflop 206, thus arming the alarm by preparing AND gate 207 for subsequent enabling by comparator 31 via line 208.

Alarm register 29 stores only hours and dekaminutes, and an alarm setting is therefore accurate only to ten minutes. During readout of the alarm setting, the minute displayed in portion 172 is zero.

THIRD POSITION OF SELECTOR

As shown in FIG. 2, the third position of the selector provides for an optical readout and setting of the information stored in auxiliary counter 28, and also provides the stopwatch mode of operation of the present invention. In order to step selector 42 to its third position, the user initially taps the transducer three times, the intervals between taps being no greater than approximately 1 second. As seen in FIG. 3*a*, the signal in line 42-3 disarms the alarm function by resetting arm alarm flipflop 206 via OR gate 210. As seen in FIG. 3*b*, the signal in line 42-3 enables AND gates 186, 187 an 212. As previously described, a stepping pulse in line 86 steps scanner 43 to its second position via gate 92 and, as seen in FIG. 3*a*, the resulting signal on line 43-2 enables gate 97 previously referred to. As seen in FIG. 3*b*, the signal on line 43-2 enables AND gate 214 and disables AND gate 216.

Because gate 186 is enabled by the absence of signal in line 43-3, the signal on line 42-3 is passed by gate 186 to enable master gate set 152 via line 155. Accordingly, the next display-on period of signal 90 will display the information stored in auxiliary counter 28 as feeder gate set 138 is sequentially enabled by the phased signals in lines 145, 146 and 147.

Auxiliary counter 28 may contain any appropriate information desired by the user such as, for example, the calendar date wherein the month is identified by number. Under those conditions, auxiliary counter 28 would closely resemble time counter 27 in having three individual counters, and feeder gate set 138 would then include three individual feeder gate sets corresponding to feeder gate sets 135, 136 and 137 which control the flow of clock time information. Each of such individual feeder gate sets would be enabled by one of the three arrowed lines extending from lines 145, 146 and 147 to feeder gate set 138.

During normal operation of the present instrument, auxiliary counter 28 receives periodic pulses from hour counter 123 via line 220, AND gate 125 and EXCLUSIVE OR gate 126. It will be noted that when selector 42 is in its first position for a time readout and optional set, the inverted signal in line 42-1 disables gate 125. This avoids the possibility that a pulse in line 220 resulting from the user's changing the setting of hour counter 123 might incorrectly be fed to auxiliary counter 28.

As in the case of the previously described time and alarm displays, the numbers stored in the auxiliary counter are displayed during the display-on period of the signal in line 90, which is followed by the 0.5 display-off interval. If the user wishes to abort operation, he can do so by a tap on the transducer during the 1.5 second display-on period. If he does nothing, then at the end of the 0.5 display-off interval, the apparatus will automatically terminate the operation, in the manner previously described. However, if the user wishes either to make a change in the information stored in the auxiliary counter, or to use the stopwatch mode of the invention, he taps the transducer once during the 0.5 display-off interval. As in the other modes of operation previously described, this will cause the numbers in the auxiliary register to be again displayed for the rest of the 0.5 second display-off interval and the following 1.5 second display-on period. During the 0.5 second display-off interval following the second 1.5 second display-on period, the user again taps the transducer; the voltage pulse so generated, in the manner previously described, will step scanner 43 to its third position. As shown in FIG. 2, this implements the stopwatch function which will be described in detail later.

In order to change the setting in auxiliary counter 28, the user steps scanner 43 to its fourth position in a manner to be later described. During the following 1.5 second display-on period of signal 90, display 38 will again show the readout of the auxiliary register. If the user taps the transducer during the following 0.5 second display-off interval, the resulting voltage pulse from gate 67 will set flipflop 96. The set output in line 96-S then enables gate 195 to pass 1 Hz pulses from line 21-15 to line 196, and thence via enabled gate 212 and gate 126 to the auxiliary register. That register's setting is thus stepped at the rate of once per second. This advancing setting is shown in display 38, since the output of enabled gate 186 enables master gate set 152. When the advancing setting arrives at the numbers desired by the user, he taps the transducer once. As previously described in connection with the setting of hours in the first position of the selector, the resulting voltage pulse steps the scanner from its fourth position and thereby terminates operation.

The stopwatch mode is implemented when the scanner is in its third position, and means are provided during this mode to prevent a pulse on line 86 from stepping the scanner to its fourth position. Thus the signal in line 43-3 (FIG. 3*b*), via enabled gate 187 produces a stopwatch mode signal in line 225 that is applied inverted to OR gate 227 which also receives the inverted signal in line 91-R. Accordingly, in this stopwatch mode, whenever flipflop 91 is in reset condition (which might enable gate 92 to pass scanner stepping pulses from line 86 via gate 94 to gate 95), the output of gate 227 disables gate 95 from passing those pulses to the scanner. The stopwatch mode signal in line 225 also maintains gate 104 enabled via gate 103 and, inverted, disables gate 108. The output of gate 187 is also fed (FIG. 3*b*) via gate 202 and line 156 to enable master gate set 153, as well as via gate 203 to enable AND gate 230.

Having stepped the scanner to its third position by a tap during the 0.5 second display-off interval following display of auxiliary counter 28, the user may start the stopwatch whenever he wishes by a single tap of the transducer. The resulting second phase pulse on line 69 sets flipflop 96 and also, via line 234, is fed to gate 228, enabled by the set output of flipflop 96 in line 96-S, thereby resetting counters 127, 128, and 130 via line 232. The signal in line 96-S simultaneously enables gate 195 to commence passing 1 Hz pulses on line 21-15 to line 196.

Those pulses, via enabled gate 230, step the counter 127 at the rate of one step per second, and that counter produces an output signal every 10 seconds, fed via gate 129 to counter 128, the latter thus being a dekasecond counter is this stopwatch mode. In turn, counter 128 produces an output signal every 6 dekaseconds, fed via gate 131 to counter 130, the latter thus being a minute counter in this mode. As above mentioned, master gate set 153 is enabled, so the advancing numbers in counters 127, 128 and 130 appear in display 38.

The user can stop the running of the stopwatch at any desired moment by tapping the transducer. The resulting first phase pulse in line 70 performs two functions: (1) via enabled gate 93, it sets flipflop 109, and (2) it holds gate 99 enabled for about 2 milliseconds —abundantly long enough for flipflop 109 to complete its transition to set condition and, via gate 99, to reset flipflop 96, thus disabling gate 195 from passing 1 Hz pulses via line 196 and gate 230 to counter 127. The reading of elapsed time in display 38 remains visible. The next timing pulse in line 86, which recurs every 2 seconds, resets flipflop 109 via gate 112, thus enabling gate 104. The user can then start the stopwatch again by a tap and, as before, the resulting second phase pulse in line 69, by setting flipflop 96 via gate 104, simultaneously resets counters 127, 128 and 130 and enables gate 195 to commence passing 1 Hz pulses from line 21-15 via line 196 and gate 230 to counter 127. The user can thus repetitively use the stopwatch capability as long as desired.

When the user has finished using the stopwatch capability and wishes to step the scanner to its fourth position, he taps the transducer twice in rapid succession, commencing no sooner than about 2 seconds after he has stopped the running of the stopwatch, so the next timing pulse in line 96 will certainly have reset flipflop 109. The first of the two rapid taps generates a signal whose first phase pulse in line 70 is nugatory. The second phase pulse in line 69 sets flipflops 91 and 96. The second of the two rapid taps generates a signal whose first phase pulse in line 70, via gate 93, sets flipflop 109 and also, via line 100, steps the scanner to its fourth position. The same pulse, via gate 99, resets flipflop 96. It may be noted that the hysteresis of flipflop 96 maintains gate 93 enabled long enough for these actions.

FOURTH POSITION OF SELECTOR

As indicated in FIG. 2, this selector position permits the user to display the minutes and seconds in counters 25,26 and 120, and then to correct those readings if necessary, by comparison to a master clock showing true time. If the display shows that the time stored in those counters is fast, i.e. ahead of true time, the user can "retard" the stored time by inhibiting one-second pulses on line 21-15 from reaching counter 25. This effectively freezes the stored time until true time arrives at the stored time. At that moment, by a tap, the user removes the inhibition, causing the one-second pulses on line 21-15 to resume feeding counter 25. On the other hand, if the display of minutes and seconds shows that the stored time is slow, i.e. behind true time, the apparatus can advance the stored time by applying the pulses on line 21-13 and also the pulses on line 21-15 to counter 25, so that counter receives two stepping pulses per second.

The numbers of minutes and seconds being thus "retarded" or advanced are shown in display 38, being measured by the stop-watch circuitry previously described in connection with the third positions of the selector and the scanner. When the user sees that the correct number of minutes and seconds has elapsed, he taps the transducer, and the apparatus resumes normal operation with the minutes and seconds of true time now stored in counters 25,26 and 120.

More specifically, the user steps the selector to its fourth position by a series of four taps at intervals of no longer than approximately 1 second. As previously described in connection with stepping the selector to its second and third positions, each tap after the first tap causes gate 59 to provide a selector stepping pulse via line 70, gate 74 and line 47.

The selector in its fourth position, as seen in FIG. 3*b*, enables gates 214 and 216 via line 42-4. As a result, while the scanner is in its second position, the signal in line 43-2 enables master gate set 150 via gate 214 and line 154; and, while the scanner is in its third and fourth positions, the absence of signal in line 43-2, fed inverted to gate 216 enables master gate set 153 via gate 202 and line 156.

After the selector arrives at its fourth position, the next pulse in line 86 steps the scanner to its second position via gates 92, 94 and 95, in the same manner as previously described. Also, as before, the 1.5 seconds display-on period of the display cycle of line 90, via gates 106 and 105 and line 107, energizes multiplex 37 and display 38 to show the information passed by master gate set 150. It may be noted that no dekaminute information is furnished to master gate set 150, so display portion 170 will show only a single digit, being the number of minutes in counter 120.

If the user is satisfied with the accuracy of the displayed minutes and seconds, he can either terminate operation by a tap during the display-on period, or allow the apparatus to automatically terminate operation at the end of the 0.5 second display-off interval following the display-on period, exactly as previously described for the earlier selector positions.

However, if he wishes to correct the displayed minutes and seconds to agree with a master clock showing the true time, he taps the transducer during the 0.5 second display interval and, as before, the resulting second phase voltage pulse from gate 67 will set flipflop 96 via gate 104, thereby reenergizing the multiplex and display via gate 105 and line 107. While the display is thus energized, the user notes the number of minutes and seconds by which the displayed time is faster or slower than true time. The user then taps during the following 0.5 second display-off interval and the resulting voltage pulse from gate 59 resets flipflop 96 via line 70 and gate 99 and simultaneously, via line 100, steps the scanner to its third position. The subsequent display will normally show four zeros.

If the previously displayed digits in counters 25,26 and 120 showed that the apparatus clock time was ahead of true time, the user taps during the 0.5 second display-off interval following the display of zeros. The resulting voltage pulse from gate 67 sets flipflop 96, and is also fed via line 234 to gate 228. The set output of flipflop 96 in line 96-S enables gate 228, so that the short pulse from gate 67 resets counters 127,128 and 130 via line 232. The set output in line 96-S, together with the display-on signal in line 90 via gate 106, keeps a constant energizing signal in line 107 fed to the multiplex and the display. Furthermore, as seen in FIG. 3*a*, since the signal in line 42-4 has enabled AND gate 240, the signal in line 96-S is fed via line 242 to NAND gate 244 and also (see FIG. 3*b*) to AND gate 246. Gate 244 being already enabled by line 43-3, its inverted output in line 248 disables gate 54, so that 1 Hz pulses in line 21-15 are prevented from reaching counter 25. Thus, the time stored in counters 25,26 and 27 is frozen, so the apparatus loses 1 second for each second of true time.

Means are provided for showing to the user the number of seconds and, if any, the number of minutes by which the apparatus is thus being retarded. In this way the user, observing the showing, can stop the retarding when the seconds and minutes equal the correction which he had already learned was necessary, thus permitting the present apparatus to resume normal operation. Such means are here shown as including the use of the stopwatch capability of counters 127,128 and 130.

More specifically, since the scanner is no longer on its second position, gate 126 is enabled and its output signal, via gate 202 and line 156, not only enables master gate set 153 but also, via enabled gate 203, enables gate 230 to pass 1 Hz pulses on line 196 to counter 127. The user then observes the changing output of the stopwatch, as appears in display 38. When that display shows the minutes and seconds by which the apparatus was originally ahead of true time, the user taps the transducer. The resulting operation is identical to that heretofore described in connection with the user's stopping of the running of the stopwatch, appearing in the penultimate paragraph of the preceding section entitled "Third Position of Selector." Resetting of flipflop 96 disables gates 240 and 244, thereby enabling gate 54 to resume passing 1 Hz pulses from line 21-15 to counter 25. Resetting of flipflop 96 also enables gate 112, so that the next timing signal in line 86 will reset flipflop 109, thus enabling gates 82,104 and 106 and disabling gate 99. The user can then abort operation by tapping the transducer during the following display-on period of signal 90 or, by doing nothing, he can permit the next stepping pulse on line 86 to step the scanner to its fourth position.

On the other hand, if the numbers of minutes and seconds displayed when the scaner was in its second position showed that the apparatus clock time was behind true time, then the user, having stepped the scanner to its third position as previously described, does nothing during the following 1.5 second display-on time and the 0.5 second display-off interval. The next stepping pulse in line 86 then steps the scanner to its fourth position. During the following 1.5 second display-on period, display 38 will normally again show four zeros. In order to cause the circuitry to advance the digit stored in counter 25, the user taps the transducer during the 0.5 second display-off interval following that display-on period of the four zeros. The resulting voltage pulse from gate 67 sets flipflop 96 and also, as in the retarding function in the scanner's third position, resets counters 127,128 and 130 via gate 228 and line 232 and applies the 1 Hz pulses in line 196 via gate 230 to counter 127.

Stopwatch counter 127 then begins to count seconds of true time, and the changing digits of counters 127,128 and 130 are shown in display 38. Simultaneously, means are provided to advance the time in counter 25 at the rate of 2 seconds for each second of true time. Such means include the feeding of the signal in line 96-S through enabled gate 240 and line 242 to enable gate 246, prepared by the signal in line 43-4, to pass the 4 Hz signal in line 21-13 to gate 55 simultaneously with the feeding of the 1 Hz signal in line 21-15 to the same gate. During four cycles of the 4 Hz signal, only two stepping pulses are fed to counter 25, the other two being effectively blanked out in gate 55 during half of each cycle of the 1 Hz signal in line 21-15. Thus, counter 25 gains 1 second for each second of true time.

As in the previous case of retarding the setting, the user observes the changing seconds and minutes shown by the display. When the display shows the seconds and minutes which he had earlier observed as the error between apparatus clock time and true time, the user taps the transducer. The resulting operation is the same as in terminating the retarding function just described, with the additional characteristic that, since the scanner is on its fourth position during the advancing function, gate 114 is accordingly enabled, so that pulse which steps the scanner will also terminate operation via gate 98. The apparatus then resumes normal time-keeping, since the resetting of flipflop 96 disables gate 240, thereby disabling gate 246 from passing 4 Hz signals to counter 25.

CONTROL TRANSDUCER AND SWITCH

Figure 5:
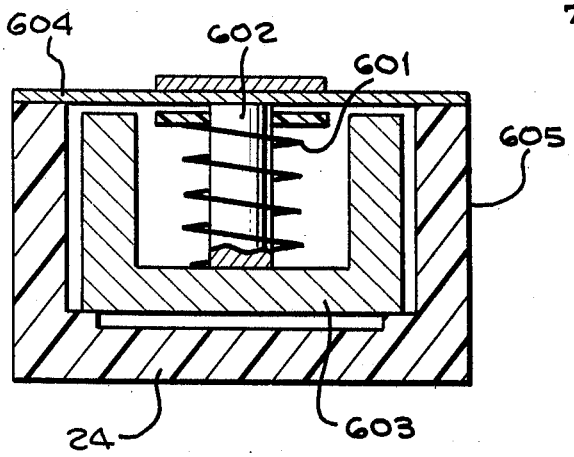
FIG. 5 is a sectional view of a typical form of transducer for use in the present invention.

As shown in FIG. 5, transducer 24 is of a type that is used in a standard hearing aid. The transducer includes a coil 601 wound around a permanent magnet element 602. One end of the magnetic element 602 is mounted in the center of a cup 603 of magnetic material mounted in a plastic case 605. A diaphragm 604 of magnetic material is mounted across the other end of the magnetic element 602 and the open circumference of the cup 603. The center of the diaphragm 604 may touch the end of element 607 but is held a short distance away from the lips of cup 603 by its contact with case 605. The magnetic attraction holds diaphragm 604 in place and pulled toward the lips of cup 603.

A current through coil 601 adds or subtracts from the magnetic field of element 602 and so changes the force on diaphragm 604. Diaphragm 604 is of a resilient material so its deflection varies with the force applied. Variation of foce with current thus causes a corresponding displacement of diaphragm 604. The apparatus thus produces sounds corresponding to the current oscillations applied. These transducers are capable of producing signals which are easily heard over a range of several feet.

Diaphragm 604 may consist of a thin disc reinforced over a center range so that it has an appropriate resonant frequency and range of movement. For use in a watch, the resonance could be enhanced for greater efficiency over a limited frequency range. The plastic case enclosing the appratus can also enclose the integrated circuit chip or be part of the case enclosing it.

When the case is tapped with the finger, relatively high G forces are applied to the diaphragm 604. The resulting deflection changes the flux in the magnetic circuit and induces a large voltage in coil 601. The voltage induced is many times larger than that which would be produced by very loud sounds as the forces on the diaphragm are very much greater. The differences are of more than two orders of magnitude or by a factor of several hundred.

The coil 601 of the earphone used should have a relatively low impedance for two reasons. one is that the size and cost would increase with the number of turns for a high impedance and the other is that the voltage required to drive it would also increase. A low impedance, such as is found in earphones commercially on the market, can be driven from a 1.5 volt battery so the same supply used for the watch can also be used for the amplifier driving the earphone. A driving current of several milliamperes is desirable to produce a sufficiently loud sound from a transducer of this type.

Figure 6:
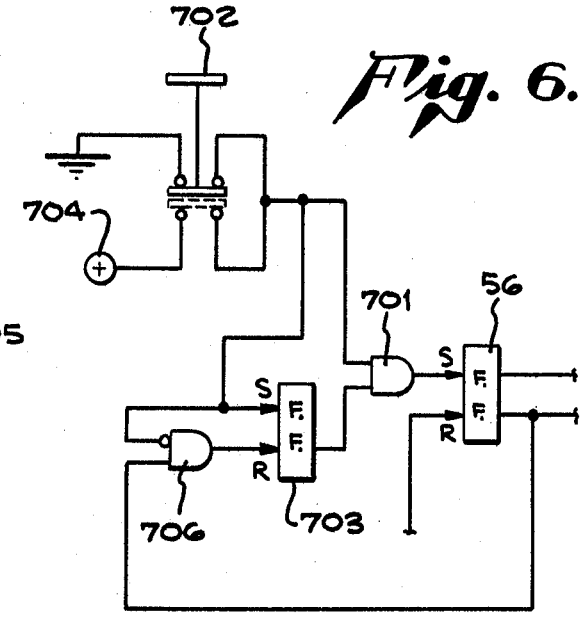
FIG. 6 is a schematic diagram of one form of a pushbutton switch which may be used in the present invention instead of the transducer shown in FIG. 5.

FIG. 6 shows circuitry including a pushbutton form of user-actuated control means which may be substituted in place of transducer 24 and amplifier 19, thereby of course foregoing the advantages of the several audible readouts which are available when transducer 24 serves as the control means, as previously described.

In the circuit of FIG. 6, the output of AND gate 701 is applied to the set input of flipflop 56. In the quiescent state of the circuit, a selectively actuatable switch 702 is in its position shown in solid lines, thus grounding the portions of the circuit shown connected to the common terminal of switch 702, and flipflop 703 is in its reset condition, thus enabling gate 701. When the user wishes to actuate the control, he moves the blade of switch 702 to its position shown in dotted outline, thus applying power from a source 704 through enabled gate 701, to set flipflop 56. The same power applied to the set input of flipflop 703 causes the latter to commence its transition to set condition, but the hysteresis of the flipflop is such that gate 701 remains enabled long enough to pass the voltage pulse from source 704 to the set input of flipflop 56. So long as the user holds switch 702 in its dotted line position, flipflop 703 will remain set, thus disabling gate 701 and preventing further application of the voltage from source 904 to the set input of flipflop 56. When the user permits the blade of the switch to return to its grounded contact, it enables AND gate 706 via its inverted input, so that a subsequent signal from the reset output of flipflop 56 will pass through gate 706 and will reset flipflop 703. The circuit is thus returned to its quiescent state, prepared to apply another control pulse to the set input of flipflop 56 when the user next actuates switch 702.

HOURLY TONE AND ALARM SIGNALS

The hourly tone signal on the hour is produced as follows, pertinent waveforms being shown in FIG. *4f*. When the output signal of dekaminute counter 121 goes negative on the hour to step hour counter 123, that signal is also fed via line 255 and is applied inverted to AND gate 258, already enabled by the set output of flipflop 256, theretofore set by the prior positive value of the signal in line 255. The output of gate 258 goes via OR gate 250 to prepare gate 252 which, when enabled by the timing signal in line 81, passes the 2 kHz tone signal from 21-4 to the transducer via gate 63. The hourly tone signal is thus a series of 2 kHz tone bursts each lasting 1/32 second and occurring each ⅛ second. The signal continues for 1 second, being turned off when the next positive-going signal on line 90 resets flipflop 256, thus disabling gate 258 and thereby gate 252.

Comparator 31 is schematicaly shown in FIG. 7 and is described in detail below. It produces an alarm control signal in line 208 only when the clock time in counters 121 and 123 is equal to the alarm time stored in alarm counters 128 and 130. Comparison is made only of hours and dekaminutes, so the alarm can be set to an accuracy only of 10 minutes. As seen in FIG. *3a*, the alarm control signal in line 208 is fed to gate 207 in alarm 34. As previously mentioned, the alarm is armed when the selector is in its second position and the scanner is in its third position, the signals in lines 42-2 and 43-3 being fed to AND gate 205, whose output signal sets flipflop 206. It may be noted that the alarm is disarmed if selector 42 is stepped to or beyond its third position, the signal in line 42-3 resetting flipflop 206 via OR gate 210.

With reference to pertinent waveforms in FIG. *4h*, the set output of flipflop 206 prepares gate 207, so that the alarm control signal in line 208 enables gate 207 to pass the 1 Hz signal of line 21-15 via OR gate 250 to prepare AND gate 252 to pass the 2 kHz tone from 21-4 when enabled by the signal in line 81 to form four tone bursts each of 1/32 second duration during each half cycle of the signal in line 21-15. Each tone burst is identical to one of the bursts previously described in connection with the hourly tone signal.

The alarm will sound for 8 seconds unless sooner turned off by the user's tapping the transducer. More specifically, the alarm control signal in line 208 enables AND gate 209 whose other input comes from OR gate 204, and whose output signal, via gate 210, resets flipflop 206 and thus turns off and disarms the alarm. One input to gate 204 is a tap-initiated pulse on line 61-S, and the other is the output signal of 1 second counter 25, whose waveform is marked 25-4 in FIG. *4g*.

Figures 7, 8:
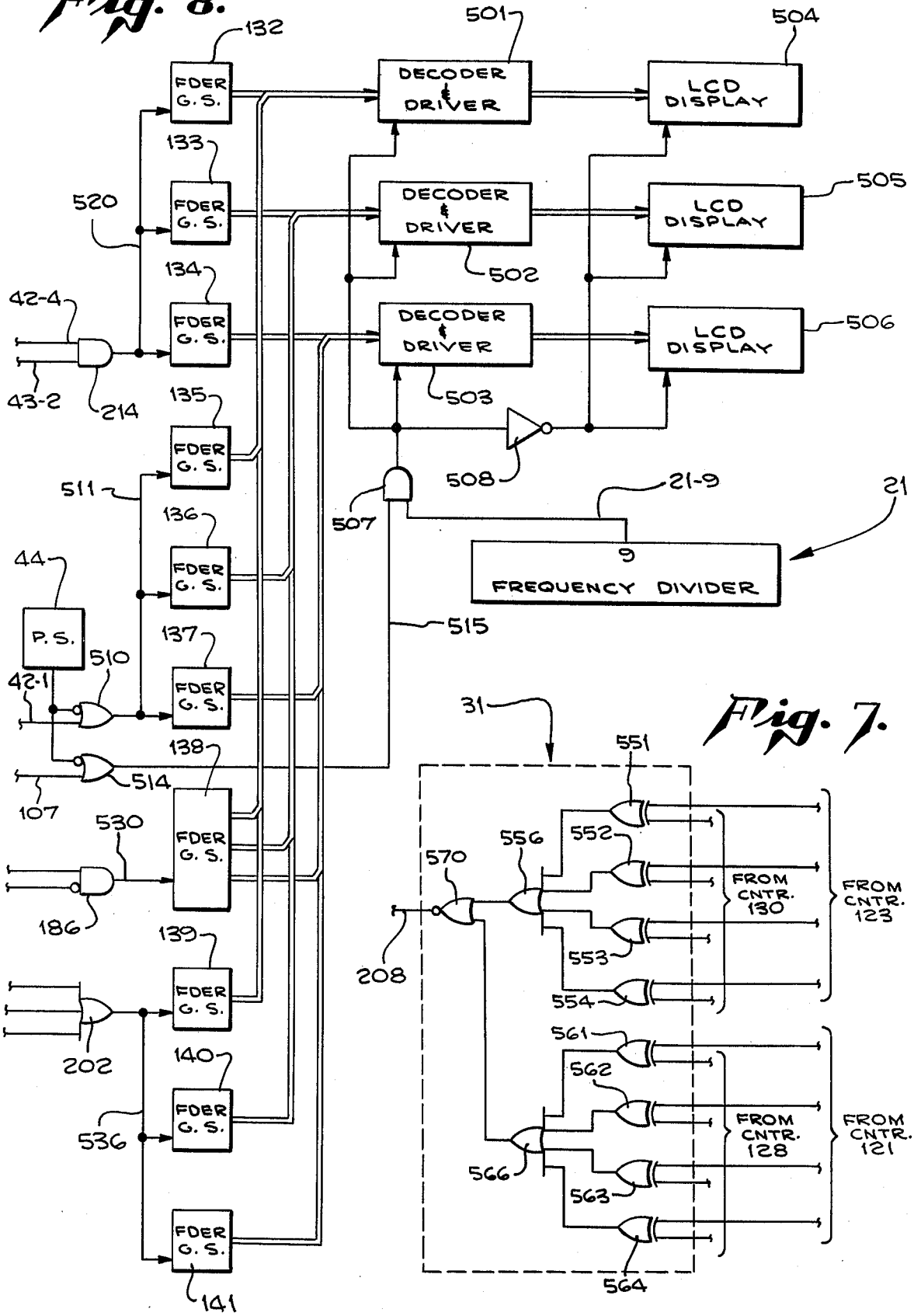
FIG. 7 is a circuit diagram of a preferred form of comparator used in the circuitry of FIGS. 3*a* and 3*b*.
FIG. 8 is a circuit diagram showing modifications of the encoding portion of the circuitry of FIG. 3*b* to use liquid crystal displays.

With detailed reference to FIG. 7, comparator 31 includes a set of four EXCLUSIVE OR gates 551–554, each receiving corresponding signals from time and alarm hour counters 123 and 130 respectively, and a similar set of four EXCLUSIVE OR gates 561–564, each receiving corresponding signals from time and alarm dekaminute counters 121 and 128 respectively. The output signals of gates 551–554 are fed via OR gate 556 to NOR gate 570, which also receives the output signals of gates 561-564 via OR gate 566, and produces an output signal in line 208. As will be evident, the signal in line 208 will assume a positive value only when each of the eight gates 551–554 and 561–564 receives identical inputs, indicating that clock time in hours and dekaminutes is equal to alarm time stored in alarm counters 128 and 130. The signal in line 208 remains positive for 10 minutes, i.e. until dekaminute time counter 121 is stepped to its next number.

CONSTANT DISPLAY OF TIME

In the circuitry of FIGS. *3a* and *3b*, it has been assumed that display 38 employs light sources, such as light-emitting diodes, whose power consumption is so high that a constant display of time would require a battery of unacceptably large size for a small instrument contemplated by the present invention. As a consequence, clock time is shown in display 38 for only a short recognition period, and only when specifically interrogated by the user, all as previously described.

FIG. 8 shows a modification of portions of FIGS. *3a* and *3b* to adapt that circuitry for use with light sources, such as liquid crystal displays (LCD herein), whose power consumption is so small as to make feasible the provision of a constant display of the clock time of the instrument held in time counter 27, as long as the timepiece is in its quiescent operational state. As will be seen, means are provided in FIG. 8 for interrupting the otherwise constant time display only when the user, by one or more of the predetermined pulse trains heretofore described, interrogates or otherwise controls the timepiece to perform one of its functions other than the mere display of clock time. The interrupting means just mentioned include means for preserving the security characteristics of the invention previously described, whereby a pulse occurring other than during a narrow time gate immediately following an optical display of the content of one of the registers will abort operation, thus preventing random pulses from changing the setting of any of the registers of the instrument.

In general, the circuitry of FIG. 8 modifies that of FIGS. *3a* and *3b* by omitting multiplex 37 and the single encoder 36 for driving display 38, and substitutes therefor a separate decoder-driver for each of the three display portions. Also, in order to minimize polarization and decomposition of the LCDs, the decoder-drivers and displays of FIG. 8 are energized by alternating current, conveniently derived at 64 Hz from the ninth stage of frequency divider 21.

More particularly, in FIG. 8, gate sets 132–141 receive the same information inputs as in FIGS. *3a* and *3b*. The outputs of the same decimal digit related to gates 132–141 are tied together and applied to the respective decoder-drivers 501, 502 and 503, which respectively drive display portions 504, 505 and 506, the latter corresponding respectively to display portions 172, 171 and 170 of FIG. *3b*. In producing a FIG. *3b* display of clock time held in counter 27, it will be recalled that multiplex 37 cyclically enables feeder gate sets 135–137 sequentially, and the outputs of the feeder gate sets are fed to master gate set 151, itself enabled by the time readout signal in line 42-1. By contrast, in producing an interrogated FIG. 8 clock time display, the time readout signal in line 42-1 is applied via OR gate 510 and line 511 to simultaneously enable feeder gate sets 135–137, whose outputs are thus simultaneously fed separately via the indicated cables to the respective decoder-drivers 501–503, which in turn drive the respective LCD displays 504–506. Additionally, whenever power supply 44 is not energized, i.e. during quiescent operation of the instrument, its inverted output is fed to gate 510 and hence keeps the feeder gate sets 135–137 enabled for the constant display of time, except as that display may be interrupted by operation of security means to be now described in connection with the supply of alternating current to the decoder-drivers and the LCD displays.

Thus an alternating current signal, illustratively at 64 Hz from the ninth stage of frequency divider 21, is applied via line 21-9 to AND gate 507, whose output is fed to decoder-drivers 501–503 and, inverted by inverter 508, to displays 504–506. OR gate 514 receives the inverted output of power supply 44, and hence enables gate 507 via line 515 during the quiescent state of the instrument. When the user interrogates or controls the instrument, power supply 44 is of course energized, so its inverted output cannot serve as a signal enabling gate 507. Under those conditions, the other input to gate 514 from line 107 becomes the controlling signal enabling gate 507, so that the LCD displays provide the same narrow time gates as those previously discussed and exemplified by the display cycle of FIG. *4b*.

For displaying the minutes and seconds as heretofore described, selector 42 is in its fourth position and scanner 43 is in its second position, and the output signals of those two positions are fed to AND gate 214. As shown in FIG. 8, the output signal of gate 214 on line 520 enables gate sets 132–134 for the minutes and seconds readout.

With respect to gate sets 138 for the auxiliary counter 28, gate 186, whose output in FIG. 3*b* is shown as enabling master gate set 152, is shown in FIG. 8 as supplying an output in line 530 to enable the three component gate sets within feeder gate sets 138.

In the case of gate set 139 and the alarm gate sets 140 and 141, the output signal of OR gate 202, which is shown in FIG. 3*b* as enabling master gate set 153, is shown in FIG. 8 as being fed via output line 536 to enable gates sets 139–141.

It will accordingly be seen that, with the exception previously discussed for the constant display of time, the circuitry of FIG. 8 is controlled by the same logic as previously discussed in detail in connection with FIGS. 3*a* and 3*b*. As is well known to those skilled in the art, liquid crystal displays and their drives are commercially available and are shown, for example, in the U.S. Pat. No. 3,820,108 to Luce.

FIFTH POSITION OF SELECTOR

This position produces an audible readout of information to be described with reference to FIGS. 9, 10*a* and 10*b*.

FIG. 9 includes most of the major components shown in FIG. 1 except auxiliary register 28, comparator 31, optical encoder 36, multiplex 37 and display 38. The included components, as well as the power supplies 44 and 45 (not shown), operate as already described. The function of the comparator 31 is performed by other circuitry in FIG. 9. Decoder 22 of FIG. 9 performs all functions of decoder 22*a* of FIG. 3*a* plus additional functions specifically related to the audible readout mode, including the production and control of tone signals.

Within audio encoder 39 the major components are indicated generally as follows: Time and alarm gate sets 300 and 302 receive information from time counter 27 and alarm register 29 respectively. When enabled during operation, these gate sets feed their information to time scan and alarm scan gates 304 and 306 respectively. Every 10 minutes code digit scanner 308 scans the hour and dekaminute information in scan gates 304 and 306 and, if parity is found by comparator 310, the latter feeds a signal to alarm control 312 which, if the alarm is armed, feeds a signal to decoder 22, which in turn feeds the alarm tone signal to transducer 24 via line 23.

Every hour on the hour time counter 27 feeds a signal to hour strike control 314 which, via audible readout control 320, enables time gate sets 300 to pass time information to time scan gates 304, where the information is scanned during cycling of code digit scanner 308. As will be later seen, the audible time readout consists of a series of tone bursts of distinctively different audible characteristics, indicated here as X-tone and Y-tone. Thus scanning of time scan gates 304 feeds Y-tone information via line 315 to Y-tone control 316, and feeds X-tone information via line 317 to X-tone control 318. The output signals of controls 316 and 318 are fed to comparator 310 via OR gate 319, and also to decoder 22, which then feeds the series of tone signals called for to the transducer via line 23.

When the user wishes an audible readout of clock time, he steps selector 42 to its fifth position by a series of five taps on the transducer, spaced at intervals no greater than about 1 second. That fifth position output on line 42-5 is fed to audible readout control 320, which, via cable 321, enables time gate sets 300 to feed their information to time scan gates 304, and simultaneously feeds a signal in line 325 which effectively controls code digit scanner 308 for the readout, as will be later described.

With reference now to the detail circuitry shown in FIGS. 10*a* and 10*b*, it will be seen that oscillator 20 drives frequency divider 21 in the same manner as previously described in connection with FIGS. 3*a* and 3*b*, and that similarly transducer 24 provides a voltage pulse, when tapped, to AND gate 57, whose output signal is fed on line 57*a* to logic 41. Gate 63 receives a 4 kHz tone signal from the third stage of frequency divider 21, as well as the timing signal in line 62, in order to produce the acknowledgment beep previously described, fed to the transducer via OR gate 64. Similarly, the output of gate 66 disables gate 57 during the tone output, in order to prevent the possibility that the tone might be interpreted by the circuitry as a second tap on the transducer. AND gates 50 and 52 receive the outputs of stages 7 and 8 of the frequency divider in the manner indicated, and as in the case of the circuitry of FIGS. 3*a* and 3*b*, produce output timing signals 51 and 53 which are fed to logic 41, the connecting lines being omitted in FIG. 10*a* for clarity of presentation. Thus the component elements of decoder 22 thus far described are identical to the correspondingly numbered components of decoder 22*a* and operate in the same manner.

Timing NOR gate 332 receives the outputs of the eleventh, twelveth and thirteenth stages of the frequency divider and produces an output timing signal in line 333 whose waveform is shown at 332 in FIG. 4*e*. NOR gate 334 receives a 500 Hz tone signal from the sixth stage of the frequency divider and, timed by the output of the thirteenth stage, feeds its output via line 335 to OR gate 336. This latter gate also receives a 2 kHz tone signal from the fourth stage of the frequency divider under the control of the timing signal in line 333 via AND gate 338, and feeds its output to AND gate 340. Gate 338 also feeds its output to AND gate 342, and the outputs of gates 340 and 342 are fed via OR gate 346 and gate 64 to transducer 24. The output of the fourteenth stage of the frequency divider and the inverted output of its fifteenth stage are fed to NOR gate 350, along with the output signal of the first stage of one-second counter 25 in line 25-1. Gate 350 feeds AND gate 354, which also receives the output of gate 332. Gate 332 also feeds AND gate 356, which also receives an input signal on line 357 to be described later, and produces an output signal in line 87 which resets flipflop 91 in logic 41, as previously described in connection with FIG. 3*a*.

As seen in FIG. 10*b*, code digit scanner 308 includes NOR gates 360–363, which produce respective output signals in lines 364–367 whose waveforms are shown in FIG. 4*d*, including the dotted portions there shown, which are effectively suppressed during an audible time readout as will be described later. As will be seen, the outputs recur every 2.0 seconds and are sequential, the outputs in lines 364 and 367 lasting 0.5 second each, and the outputs in lines 365 and 366 lasting 0.25 second each. Each of gates 360–363 receives an input on line 325 which, as seen in the lower portion of FIG. 10*b*, carries the output signal of AND gate 370, enabled by 42-5 to pass the output signal of toggle flipflop 369 which, as described below, produces a 0.25 Hz square wave signal during an audible readout cycle. Thus NOR gates 360–363 can produce output signals only during the 2.0 second period while the signal in line 325 is low. It may also be noted that the output signal of gate 370 is fed via branch line 116 to OR gate 94 within logic 41 in order to step scanner 43 every 4.0 seconds during readout.

During the 2.0 second readout period, the controlling inputs to gates 360–363 are the outputs of the fourteenth and fifteenth stages of frequency divider 21 in lines 21-14 and 21-15 respectively, together with the 0.5 Hz signal in line 25-1. The signals in lines 364–367 respectively enable AND gates 374-377 of time scan gates 304 as well as respective AND gates 384-387 of alarm scan gates 306.

Time gate sets 300 include a minute gate set 390, a dekaminute gate set 391 and an hour gate set 392, and alarm gate sets 302 include a dekaminute gate set 396 and an hour gate set 397.

Time gate sets 390, 391 and 392 receive digital time information from counters 120, 121 and 123 respectively. When those gate sets are enabled, in a manner to be described below, they pass their inputs via cable 400 to gates 374–377. Similarly, gate sets 396 and 397 receive digital information of the time stored in alarm counters 128 and 130 respectively. When enabled in a manner to be described below, gate sets 396 and 397 pass their information via cable 402 to gates 384–387.

The output signals of gates 374 and 375 are fed to Y-tone control 316, here comprising an OR gate, whose output is fed to line 407. The output signals of gates 376 and 377 are fed to X-tone control 318, here shown also as comprising an OR gate, whose output is fed to line 409. The signals in lines 407 and 409 are fed to gates 340 and 342 respectively, and the signals in both lines are also fed to EXCLUSIVE OR gate 414 of comparator 310, via gate 319. The output signals of alarm scan gates 384–387 are fed via OR gate 412 to gate 414 of the comparator. The detailed functioning of the comparator during the periodic alarm check will be described below under the heading "Hourly Strike and Alarm Signals."

AUDIBLE TIME READOUT

The audible readout of time consists of a series of tone bursts. For ease of recognition and comprehension by the user, two easily distinguishable types of tone bursts are employed in the present form of the invention, identified as X-tone and Y-tone. With reference to the waveforms of FIG. 4*e*, a continuous series of X-tone bursts is produced by gate 338, and these are fed to the transducer when AND gate 342 is enabled. Each X-tone burst is a monotone of 2000 Hz lasting for 1/32 second. Similarly, gate 336 produces a continuous series of Y-tone bursts, which are fed to the transducer when AND gate 340 is enabled. Each Y-tone burst is a composite sound resulting from combining an X-tone burst with a tone burst from gate 334, the latter having a frequency of 500 Hz and lasting for ⅛ second. In translating a series of tone bursts into a number, each Y-tone burst has a numerical value of four, while each X-tone burst has a value of one. As will be seen, the Y-tone burst or bursts for each number being read out are produced before the X-tone burst or bursts for that number.

The following table shows, for each arabic number from one to twelve, the binary form of the number, and the operative one or more of the gates 374–377 to produce the tone bursts for that number. It is to be kept in mind, as shown in FIG. 4*d*, that gates 364 and 367 are enabled for twice as long a period as are gates 365 and 366, and hence that each enabling of gates 374 and 377 lasts long enough for two Y-tone an X-tone bursts respectively, while each enabling of gates 375 and 376 lasts only long enough for one Y-tone and X-tone burst respectively.

| Number | Binary Form | Gates Enabled 364 | 365 | 366 | 367 |
|---|---|---|---|---|---|
| 1 | 0 0 0 1 | — — | — | X | — — |
| 2 | 0 0 1 0 | — — | — | — | X X |
| 3 | 0 0 1 1 | — — | — | X | X X |
| 4 | 0 1 0 0 | — — | Y | — | — — |
| 5 | 0 1 0 1 | — — | Y | X | — — |
| 6 | 0 1 1 0 | — — | Y | — | X X |
| 7 | 0 1 1 1 | — — | Y | X | X X |
| 8 | 1 0 0 0 | Y Y | — | — | — — |
| 9 | 1 0 0 1 | Y Y | — | X | — — |
| 10 | 1 0 1 0 | Y Y | — | — | X X |
| 11 | 1 0 1 1 | Y Y | — | X | X X |
| 12 | 1 1 0 0 | Y Y | Y | — | — — |

The user interrogates an audible time readout by stepping selector 42 to its fifth position by a series of five taps on the transducer at intervals of no more than approximately 1 second, in the manner heretofore described. The next pulse on line 86 then steps scanner 43 to its second position, and the resulting signal on line 43-2 (see FIG. 10*b*) is fed via OR gate 420 to enable gate set 392 and, irrelevantly, gate set 397. Enabling of gate set 392 feeds digital time information from hour counter 123 via cable 400 to the individual gates of time scan gates 304, gate 374 receiving the highest order digit, gate 375 the next order digit, gate 376 the third order digit and gate 377 the lowest order digit. When any of these gates has a "1" as its input from cable 400, it is enabled to pass the scanning signals from lines 364–367. Gates 374 and 375 control Y-tone gate 340 via gate 316 and line 407, while gates 376 and 377 control X-tone gate 342 via gate 318 and line 409.

In order to facilitate the user's recognition and comprehension of each number during the audible readout, means are included for providing a silent interval of at least 2.5 seconds following the tone burst or bursts identifying the hour before the dekaminute readout cycle begins, and a similar silent interval between the dekaminute tone burst or bursts and those identifying the minute digit. Thus, with reference to FIG. 4*d*, the dotted portions of the waveforms are suppressed for alternate 2.0 second cycles during readout of the three numbers identifying the time.

The means for so suppressing alternate cycles are here shown as including toggle flipflop 369 which receives a toggling input pulse every 2.0 seconds from line 86. If this flipflop is clamped by the output signal of scanner 43 in its first position, the flipflop feeds a 0.5 Hz square wave signal to gate 370, but during a readout the clamp is removed and flipflop 369 then feeds a 0.25 Hz square wave signal to gate 370. Since line 325 provides an input signal to each of the four gates 360–363, during the 2.0 second period when the signal in that line is positive, scanner 308 will produce no signals, and the apparatus hence produces no audible readout. Also, the timing pulse in line 87 is suppressed during the silent interval, since there is then no signal in line 357 to enable gate 356, and the signal in line 90 is also suppressed since it is derived from gate 363.

Audible readout of the dekaminute number in counter 121 and, subsequently, of the minute number in counter 120 is performed similarly to the readout of the hour number just described. Thus, scanner 43 in its third position produces a signal in line 43-3 which (see FIG. 10*b*) is fed via OR gate 422 to enable gate set 391 to pass dekaminute information from counter 121 via cable 400 to time scan gates 374–377. After that readout and the following silent interval, scanner 43 is stepped to its fourth position and its output signal in line 43-4 enables gate set 390 to pass minute information from counter 120 via cable 400 to time scan gates 374–377. The subsequent stepping signal in line 116 not only steps the scanner, but also terminates operation by a signal via gate 114 (see FIG. 3*a*) as previously described.

Means are provided during the audible readout just described for preventing such readout from being interpreted by the circuitry as a tap on the transducer. Thus, AND gate 424 in audible readout control 320 is enabled by the signal on line 42-5, and when scanner 43 is stepped from its first position to its second, the inverted signal on line 43-1 is fed by gate 424 via OR gate 426 and line 117 to gate 66, whose output disables gate 57.

HOURLY STRIKE AND ALARM SIGNALS

Hour strike control 314 provides an automatic audible readout of the hour in counter 123, and corresponds generally to the hourly tone signal previously described in connection with flipflop 256 and AND gate 258 of FIG. 3*a*. As will be understood, hour strike control 314 may be substituted for flipflop 256 and gate 258, in order to provide a more elaborate hourly readout by a set of tone signals identifying the particular hour, rather than the simple information provided to the user as previously described in connection with FIG. 3*a*, indicating merely that an unidentified hour had passed.

Within hour strike 314 there are provided a flipflop 430 and AND gate 432, corresponding respectively to flipflop 256 and gate 258 of FIG. 3*a*. Flipflop 430 is reset every 4 seconds by the signal on line 25-2 so that the hour is read out only once each hour. When the output signal of dekaminute counter 121 goes negative on the hour to step hour counter 123, that signal is also fed via line 255 and is applied inverted to gate 432, already enabled by the set output of flipflop 430, theretofore set by the prior positive value of the signal in line 255. The output of gate 432 enables gate set 392 as well as, irrelevantly, gate set 397. This will cause an audible readout of the hour stored in counter 123, in the manner previously described. The enabling signal in line 435 is also fed, via gates 426 and 66, to disable gate 57 during the audible readout for reasons previously discussed.

Alarm control 312 includes means for arming the alarm, and for controlling the production of the alarm signal when the clock time arrives at the time stored in alarm register 29. As previously described in connection with circuit operation when selector 42 is in its second position, thus enabling gate 205, the alarm is armed when scanned 43 arrives at its third position, by reason of the fact that the signal in 43-3 is fed via enabled gate 205 to set flipflop 440, which corresponds functionally to flipflop 206 in the circuitry of FIG. 3*a*. That flipflop will be later reset, and the alarm thus disarmed and turned off, by the signal in line 42-3 via OR gate 442 if the selector arrives at its third position, as well as by other conditions to be described later. The set output signal of flipflop 440 in line 440-S partially enables AND gate 444, which controls the alarm check performed every 10 minutes in the following manner.

Every 10 minutes counter 120 feeds a negative-going pulse via gate 122 to dekaminute counter 121. That pulse, via line 445, removes the theretofore existing signal to the set input of flipflop 446 and to the reset input of flipflop 470, thereby permitting those flipflops to be actuated to their opposite conditions by subsequent signals described below. The pulse, inverted, also enables AND gate 460, and is fed via enabled gate 444 to AND gates 450 and 452, which are enabled during alternate two-second periods by the output of the second stage of counter 25 in line 25-2. Hence, gate 450 supplies an enabling signal via gate 420 to hour gate sets 392 and 397 for 2 seconds and, during the following 2 seconds, gate 452 supplies an enabling signal via gate 422 to dekaminute gate sets 391 and 396. In this way the hour readouts of time scan gates 304 and alarm scan gates 306 are accomplished during the first two-second period, and the corresponding dekaminute readouts are accomplished during the second two-second period. At the end of 4 seconds, the positive-going signal in line 25-3 resets flipflop 446, thus terminating the alarm check cycle.

The outputs of gates 374–377, via gates 316, 318 and 319, are applied to EXCLUSIVE OR gate 414, which also receives the outputs of gates 384-387. During the alarm check cycle, if the numbers in the clock time counters 121, 123 differ from the corresponding numbers in the alarm counters 128, 130, gate 414 produces a signal which sets flipflop 470, thus disabling AND gate 474. But if the compared numbers are the same, gate 414 produces no signal, flipflop 470 remains reset, and gate 474 remains enabled.

The positive-going signal in line 25-3, previously mentioned as terminating the alarm check cycle by resetting flipflop 446, also enables gate 460 to pass the next timing signal on line 86 to gate 474. If that gate is enabled, the line 86 signal sets flipflop 478, which enables AND gate 480 via line 479. The 1 Hz square wave timing signal on line 21-15 thus goes via line 481 to enable AND gate 482 to pass the 2 kHz tone signal of line 21-4 via gates 346 and 64 to the transducer, thereby sounding the alarm. As in the case of previous tone signals described, line 481 also feeds gate 66, whose output cyclically disables gate 57 for reasons previously described. The 1 Hz signal in line 481 is also fed inverted to AND gate 483 so that, during the low half cycle of that signal, the latter gate is enabled to pass a signal from OR gate 484 via gate 442 to reset flipflops 440 and 478, thereby disarming the alarm and turning off the alarm signal. Eight seconds after the alarm begins (cf. FIG. 4*g*), gate 484 receives such a termination signal from line 25-4. Also, during any of the 0.5 second silent intervals of the alarm signal, the use can tap the transducer, and the resulting signal on line 62 will disarm and turn off the alarm via gates 484, 483 and 442.

I claim:

1. In an electronic timepiece having means for producing a timing signal at a standard low frequency, a duration register, and optical readout means, the provision of:

selectively activatable means for applying the timing signal to the duration register;

first gating means energizable by a first predetermined pulse train for activating said applying means;

means operatively connecting the duration register to the optical readout means;

second gating means energizable by a second predetermined pulse train for deactivating said applying means;

and a single control selectively actuatable by the user to produce each pulse in said pulse trains.

2. The invention as defined in claim 1 including means actuated by said first gating means for momentarily zeroing the duration register.

3. The invention as defined in claim 1 wherein said connecting means is activated by said first predetermined pulse train.

4. The invention as defined in claim 3 including means energizable by a third predetermined pulse train for deactivating said connecting means.

5. The invention as defined in claim 1 including a time register for holding clock time and means for feeding the timing signal to the time register, and wherein the time register is operatively connectable to the optical readout means.

6. The invention as defined in claim 5 including third gating means energizable by a third predetermined pulse train for operatively connecting the time register to the optical readout means during a given display period.

7. The invention as defined in claim 5 including means energizable by a third predetermined pulse train for setting a desired time into said duration register, and means for generating an alarm indication when said time register and said duration register hold the same time.

8. The invention as defined in claim 7 wherein said control comprises a sound transducer adapted to produce an electrical signal when tapped, and wherein said generating means generates an audible frequency signal to drive said transducer.

9. The invention as defined in claim 5 including means energizable by a third predetermined pulse train for changing the frequency of the signal fed to said time register during the interval between said first and second predetermined pulse trains.

10. The invention as defined in claim 5 including means disabling said feeding means during the interval between said first and second predetermined pulse trains.

11. An electronic timepiece including means for producing a timing signal of standard low frequency, a time register, means for feeding the timing signal to the time register, and a readout means, said timepiece having a quiescent operational state in which said time register holds clock time therein in numerical form and a setting operational state, the combination of:

means responsive to a predetermined pulse train for conversion of the timepiece from its quiescent state to its setting state wherein a subsequent pulse train changes one of the numbers held in the time register, said pulse train including first and second pulse train segments separated by an abort period;

security means responsive to a pulse occurring during the abort period for preventing said conversion;

and control means actuatable by the user for producing said pulses.

12. The invention as defined in claim 11 wherein said readout means produces a visible display and including means for altering a characteristic of said display in timed relation with the end of said abort period.

13. The invention as defined in claim 11 wherein said pulse train includes a third pulse train segment separated from said second pulse train segment by a second abort period.

14. The invention as defined in claim 11 wherein the time duration of the abort period is substantially longer in duration than that of each of the pulse train segments.

15. The invention as defined in claim 11 including means energized by a first subsequent pulse train for changing the frequency of the signal fed to said register, and means energized by a second subsequent pulse train for causing the timepiece to revert to quiescent operation.

16. The invention as defined in claim 11 including means energized by a first subsequent pulse train for disabling said feeding means, and means energized by a second subsequent pulse train for causing the timepiece to revert to quiescent operation.

17. The invention as defined in claim 11 wherein said time register includes a plurality of counters in cascade, the first of said counters receiving the timing signal during quiescent operation, and including means energized by a first subsequent pulse train for applying the timing signal to another of said counters, and means energized by a second subsequent pulse train for disabling said applying means.

18. In an electronic timepiece having means for producing a timing signal of standard low frequency, a plurality of registers, and optical readout means comprising a display, the combination of:

a control selectively actuatable by the user;

means for selecting a desired one of the registers in response to a coded number of sequential actuations of said control;

means energizing the display during a display-on period of a predetermined duration;

security means responsive to an actuation of the control during the display-on period for returning the timepiece to quiescent state;

and means for gating the information in the selected register to the readout means.

19. The invention as defined in claim 18 wherein said display-on period is followed by a display-off interval of shorter duration than said period, and including means responsive to an actuation of the control during the display-off interval for reenergizing the display for a second display-on period followed by a second display-off interval, means responsive to an actuation of said control during said second display-off interval for changing the setting of said selected register, and means responsive to a subsequent actuation of said control for returning the timepiece to quiescent state.

* * * * *